US007780232B2

(12) United States Patent
Miller

(10) Patent No.: US 7,780,232 B2
(45) **Date of Patent: *Aug. 24, 2010**

(54) THREE-PIECE KNIT FORM-FIT SLIPCOVER

(75) Inventor: Brenda Kay Miller, Jersey Shore, PA (US)

(73) Assignee: Sure Fit Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/205,609

(22) Filed: Sep. 5, 2008

(65) Prior Publication Data

US 2008/0315641 A1 Dec. 25, 2008

Related U.S. Application Data

(63) Continuation-in-part of application No. 11/285,916, filed on Nov. 23, 2005, now Pat. No. 7,422,281.

(60) Provisional application No. 61/027,312, filed on Feb. 8, 2008.

(51) Int. Cl.
*A47C 31/11* (2006.01)

(52) U.S. Cl. ..... 297/224; 297/225; 297/228; 297/228.1; 297/229

(58) Field of Classification Search ..... 297/224, 297/225, 228, 228.1, 229
See application file for complete search history.

(56) References Cited

U.S. PATENT DOCUMENTS 1,825,909 A 10/1931 Levi
1,942,111 A 1/1934 Levi
2,083,236 A 6/1937 Levi
2,086,640 A 7/1937 Reynolds
2,098,684 A 11/1937 Fry
2,100,868 A 11/1937 Oppenheimer
2,123,667 A 7/1938 Trubitz (Continued)

FOREIGN PATENT DOCUMENTS

FR 2690322 10/1993

OTHER PUBLICATIONS

Stretch and Cover Pull it on. Show it Off Brochure. 3 pages.

(Continued)

*Primary Examiner*—Rodney B White
(74) *Attorney, Agent, or Firm*—Leason Ellis LLP

(57) ABSTRACT

A multi-piece slipcover for a piece of furniture having a base including a back, a seat, and a pair of armrests, and one or more seat cushions and back cushions that are unattached to the base. A base cover of the multi-piece slipcover includes one or more panels for covering the back, the left and right armrests, and at least a portion of the seat of the base. One or more seat cushion covers and one or more back cushions covers cover the one or more seat cushions and back cushions, respectively. At least one of the one or more back cushion covers has trapezoidally-shaped front and rear surfaces, and is made from a fabric having a stretch in length which behaves dynamically with respect to a stretch in width. A minimum stretch in fabric width is 60%, while a minimum stretch in fabric length is 40%.

33 Claims, 29 Drawing Sheets

U.S. PATENT DOCUMENTS

| | | | | |
|---|---|---|---|---|
| 2,183,828 | A | 12/1939 | Trubitz | |
| 2,350,359 | A | 6/1944 | Krasnov et al. | |
| 2,839,127 | A | 6/1958 | Schutte | |
| 2,848,039 | A | 8/1958 | Lenz | |
| 2,877,832 | A | 3/1959 | Reavis | |
| 2,884,993 | A | 5/1959 | Schutte | |
| 2,921,625 | A | 1/1960 | Krasnov et al. | |
| RE25,133 | E | 3/1962 | Reavis | |
| 3,116,953 | A | 1/1964 | Sugarman | |
| 3,117,817 | A | 1/1964 | Mednick | |
| 3,311,408 | A | 3/1967 | Sarvas | |
| 3,589,770 | A | 6/1971 | Kelley | |
| 3,614,156 | A | 10/1971 | Sarvas | |
| 4,694,511 | A | 9/1987 | Estes et al. | |
| 5,275,463 | A | 1/1994 | Rocha | |
| 5,549,355 | A | 8/1996 | Illulian | |
| 5,626,388 | A | 5/1997 | Haltner | |
| 5,664,831 | A | 9/1997 | White et al. | |
| 5,664,832 | A | 9/1997 | Stevens et al. | |
| 5,676,422 | A | 10/1997 | White et al. | |
| 5,733,002 | A | 3/1998 | Riley et al. | |
| 6,116,685 | A | 9/2000 | White et al. | |
| 6,155,637 | A | 12/2000 | Waters | |
| 6,398,301 | B1 | 6/2002 | Illulian | |
| 6,659,550 | B2 | 12/2003 | Hackett | |
| 6,796,609 | B2 | 1/2004 | Illulian | |
| 6,827,398 | B2 | 4/2004 | Nazginov | |
| 6,736,453 | B2 | 5/2004 | Chambers et al. | |
| 6,782,590 | B2 | 8/2004 | Rock et al. | |
| 7,360,834 | B2 * | 4/2008 | Miller et al. | 297/225 |
| 7,377,585 | B2 * | 5/2008 | Neustat | 297/225 X |
| 7,422,281 | B2 * | 9/2008 | Miller | 297/224 |
| 7,431,394 | B2 * | 10/2008 | Neustat | 297/225 X |
| 7,472,954 | B2 * | 1/2009 | Miller | 297/225 |
| 2004/0155499 | A1 | 8/2004 | Chambers et al. | |
| 2006/0105658 | A1 | 5/2006 | Patz et al. | |
| 2008/0290705 | A1 * | 11/2008 | Neustat et al. | 297/225 |

OTHER PUBLICATIONS

"www.surefit.net <http://www.surefit.net>", Reclining In Style, Brochure, 1997.

Maytex Mills, Inc. The Revolutionary Slipcover, Instruction Manual, Circa 2007.

Madison Industries, Inc. "Recliner Furniture Cover", Brochure, Circa 2007.

Texstyle Fashion & Design "Slipcover Stretch Recliner, Instructions for Stretch Recliner", Circa 2007.

www.stretchandcover.com <http://www.stretchandcover.com> "Stretch and Cover Expandables Slipcovers, 18—Recliner Slipcovers", 2005.

Stretch & Cover Expandable Slipcovers, The Only Ready-Made that Rivals Custom-Made, 2005 Stretch and Cover, Brochure, 2005.

Domestications Catalog; Recliner Cover Sets by SureFit, pp. 84-85, Circa 2003.

Stretch and Cover Instructions Sheet (2009, but believed to describe product of 2005).

* cited by examiner

THREE-PIECE KNIT FORM-FIT SLIPCOVER

CROSS-REFERENCE TO RELATED APPLICATION

The present patent application is a continuation-in-part of U.S. patent application Ser. No. 11/285,916, filed on Nov. 23, 2005 and entitled "Knit Form-Fit Slipcover," and claims priority under 35 U.S.C. §119(e) to U.S. Provisional Patent Application No. 61/027,312, filed on Feb. 8, 2008 and entitled "Three-Piece Knit Form-Fit Slipcover." The content of each of these applications is hereby incorporated by reference herein in its entirety.

FIELD OF THE INVENTION

The present invention relates to a knit form-fit slipcover for a piece of seating-type furniture, such as a chair, loveseat, or sofa, and in particular to a multi-piece knit form-fit slipcover for furniture having removable seat and/or back cushions.

BACKGROUND OF THE INVENTION

Slipcovers are widely used by consumers as an inexpensive alternative to re-upholstering a piece of seating-type furniture. Originally, slipcovers were custom tailored by a professional having the proper tools and training to precisely fit a particular piece of furniture. Custom tailored slipcovers, however, are typically as expensive as the cost of re-upholstering the piece of furniture.

Prefabricated slipcovers that can fit a variety of furniture items of typical dimensions and which can be more readily applied by the consumer have been designed. Though these slipcovers tend to be less expensive to produce than custom-tailored ones, they can be difficult to design to accommodate various styles and shapes of furniture, and often result in an unsatisfactory appearance due to improper fit.

U.S. Pat. No. 7,210,739, issued May 1, 2007, discloses a multi-piece slipcover for accommodating a piece of furniture having removable seat cushions. The removable seat cushions are covered by a single bag-like cover into which the seat cushions are inserted, leaving excess material extending beyond the cushions. The excess material is folded under the cushions at each end to hold the material on the upper surface of the cushions taut when the cushions are in place on the on the furniture seat.

For added comfort, it is popular presently to manufacture chairs, sofas and like furniture having one or more loose back cushions and seat cushions produced in a variety of shapes and sizes. Attempting to cover the back cushions with the two-piece slipcover of U.S. Pat. No. 7,210,739 is however somewhat problematic. Typically, the base cover would first be applied to the furniture, the seat cushion covers would then be applied to the seat cushions, the covered seat cushions would then be placed onto the furniture seat, and the base cover would then be partially removed to place the back cushions on the back and on the seat cushions. Finally, the partially-removed base cover would be reapplied to cover the back cushions.

U.S. Pat. No. 6,659,550 discloses an upholstery system that includes a partial slipcover for covering one or more loose back cushions. Each partial slipcover is made of a non-stretch fabric with an opening at one end that can be closes by means of an elastic cord closure. However, because the non-stretch slipcovers are intended to cover a variety of shapes of back cushions, the covers are not form-fitted to the back cushions, and therefore may be insecure and may exhibit undesirable creases and excess material in some applications.

It would be advantageous to provide a form-fit slipcover capable of accommodating loose back cushions securely, and capable of being applied with a less difficult assembly procedure than that presented by current two-piece systems.

BRIEF SUMMARY OF THE INVENTION

The present invention is directed to a multi-piece slipcover for covering a piece of furniture having a base including a back, a seat, and a pair of armrests, and having one or more seat cushions and back cushions that are unattached to the base. The multi-piece slipcover includes a base cover including one or more panels for covering each of the back, the left and right armrests, and at least a portion of the seat. In addition, the multi-piece slipcover includes one or more seat cushion covers and one or more back cushion covers. At least one of the one or more back cushion covers has trapezoidally-shaped front and rear surfaces, and comprises a fabric having a stretch in length which behaves dynamically with respect to a stretch in width, with the minimum stretch in fabric width being 60%, the minimum stretch in fabric length being 40%.

Preferably, the least one back cushion cover further comprises an opening at a bottom edge admitting the one or more back cushions to an interior of the at least one back cushion cover, and a zipper for reversibly sealing the opening. In addition, the at least one back cushion preferably includes a gusset panel which is positioned within the interior of the at least one back cushion cover, adjacent to a longitudinal end of the zipper, to form a gusseted area that stretches for a form-fit to back cushions of varying thicknesses.

BRIEF DESCRIPTION OF THE DRAWINGS

The foregoing and other features of the present invention will be more readily apparent from the following detailed description and drawings of illustrative embodiments of the invention, wherein like reference numerals delineate similar elements throughout the several views. In the drawings.

DETAILED DESCRIPTION OF CERTAIN EMBODIMENTS OF THE INVENTION

Figure 1:
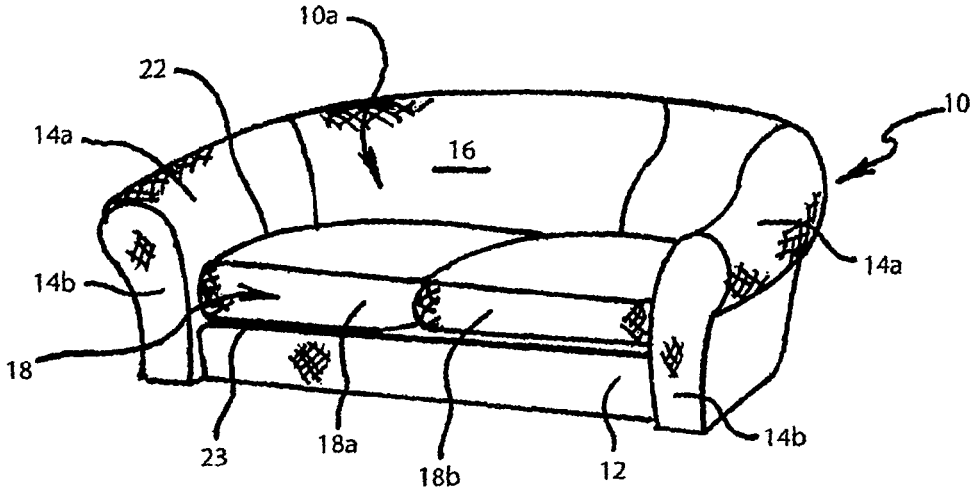
FIGURE 1 PRIOR ART
FIG. 1 is a perspective view of a front side of a conventional item of seating-type furniture, in the form of a sofa.
Figure 2:
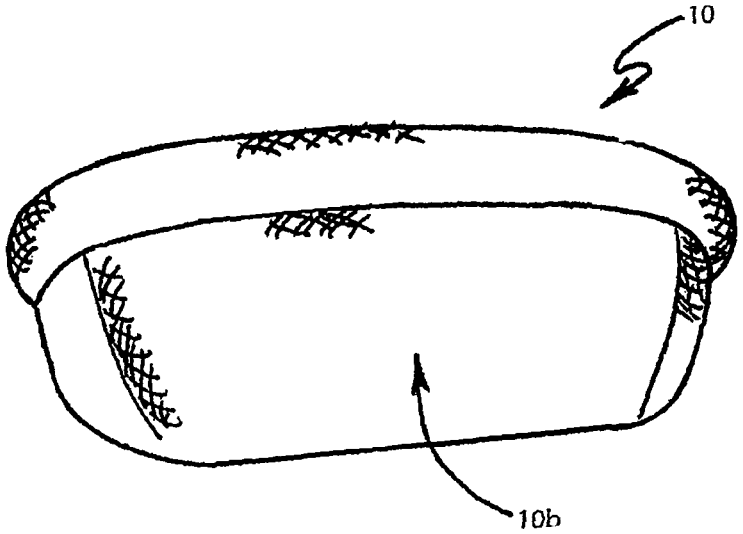
FIGURE 2 PRIOR ART
FIG. 2 is a view of the rear side of the item of seating-type furniture illustrated in FIG. 1.

FIGS. 1 and 2 illustrate a typical item of seating-type furniture 10, which for purposes of this example, is a seat in the form of a sofa. It will be noted, however, that slipcovers according to the present invention may be used in combination with any of a variety of types of seating-type furniture having a base, a back, at least one seat cushion (in the shape of a box (as shown) or a T-shape, for example), and at least one back cushion. FIG. 1 illustrates the front side 10*a* (i.e., the seated side) of the sofa 10, while FIG. 2 illustrates the rear side 10*b* of the sofa. The sofa includes a seat base 12, which is typically somewhat rigid so that it can support the rest of the furniture body and things which may be positioned thereon, such as a person (not shown). The base 12 can assume a variety of shapes, and may include supplemental legs (not shown) or the like.

The sofa 10 preferably includes first and second arms 14 (which include arm sides 14*a* and arm fronts 14*b*), which extend upwardly from opposite ends of the base 12, and are connected to each other by way of a sofa back 16. The back 16 is illustrated as being relatively smooth and continuous, though it is noted that any of a variety of shaped sofas could also be used in combination with a slipcover according to the present invention. For example, the back 16 of the sofa 10 to be covered can be of the conventional camel back shape, or the like.

A cushioned region 18 (i.e., individual cushions 18*a*, 18*b*), which is separable from the seat base 12, extends substantially horizontally across the sofa base 12, to provide a sitting surface for a user of the sofa 10. In FIG. 1, the cushioned region 18 includes first and second individual seat cushions 18*a*, 18*b*. It is noted, however, that items of furniture usable in combination with slipcovers of the present invention can include a single bench-style cushion or three or more seat cushions.

The present invention is realized through stretch properties of the slipcover fabric having a stretch in length and a stretch in width which behave dynamically with respect to each other. The minimum stretch in fabric width is 60%, and the minimum stretch in fabric length is 40%. The slipcover is form-fit to the furniture when the stretch in fabric width is 60% is reduced by 10%, and the stretch in fabric length is 40% is reduced by 25%. The slipcover fabric preferably has a minimum of 5% spandex or other suitable elastic fiber. A suitable testing method used to measure the stretch properties of the slipcover fabric is outlined in the ASTM reference manual as ASTM D2594[1]. Suitable stretch materials available commercially include, for example, CLEERSPAN and GLOSPAN by RadiciSpandex Corp. of Gastonia, N.C.; DORLASTAN by Asahi Kasei Europe GmbH of Dormagen, Germany; XLA by The Dow Chemical Company of Midland, Mich., ESP and LYCRA by INVISTA of Wichita, Kans., and REFLEXX by Uniti, Inc. of Greensboro, N.C.

"Standard Test Method for Stretch Properties of Knitted Fabrics Having Low Power," ASTM D2594, American Society for Testing and Materials, Dec. 1, 2004.

According to a first embodiment of the present invention, the fitted slipcover base is specifically designed to fit a variety of furniture with T-shaped cushions. Specific attributes of T-cushion furniture addressed with this design are a deeper seat depth, a shorter side width, a T-shaped base, and a shorter arm height. This slipcover is of two-piece construction, and has a separate fitted T-shaped cushion cover that is applied over the seat cushion(s) located on the furniture.

More specifically, the slipcover has a fitted T-shaped base that is designed to fit a range of T-cushion furniture bases to hug the face of the arm(s), the T-area of the seat, and the perimeter or base of the furniture where a band with enclosed free-floating elastic holds a base portion of the slipcover to the underside of the furniture. The arm front in a relaxed state fits narrow arm widths, and dynamically stretches to fit wider arm widths. The fabric will also relax or stretch to accommodate a range of arm heights. An advantage of the T-shaped cushion cover of the present invention is the ability to cover any number of cushions present on the furniture with one seat cover that form fits to the shape of the cushion(s) via the dynamic stretch of the fabric.

Figure 3A:
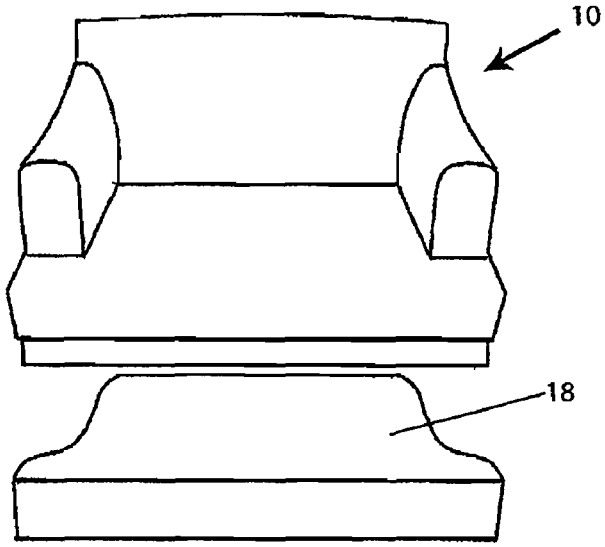
FIGS. 3A through 3F are perspective views of a slipcover with removable seat cushions being applied to the seating-type furniture illustrated in FIG. 1.
Figure 3B:
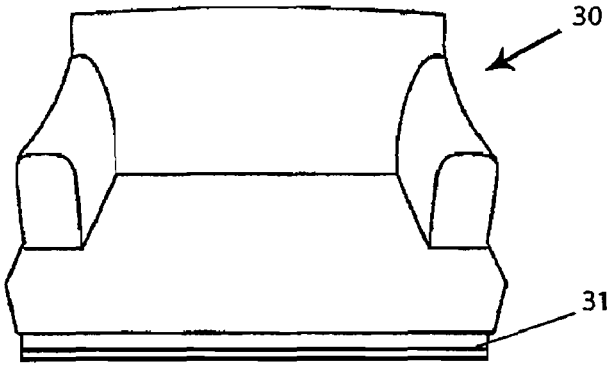
Figure 3C:
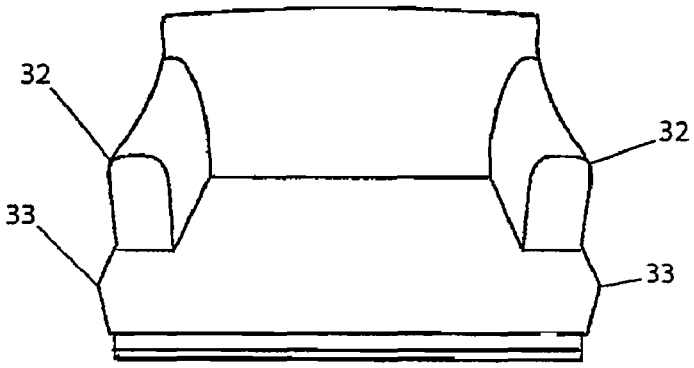
Figure 3D:
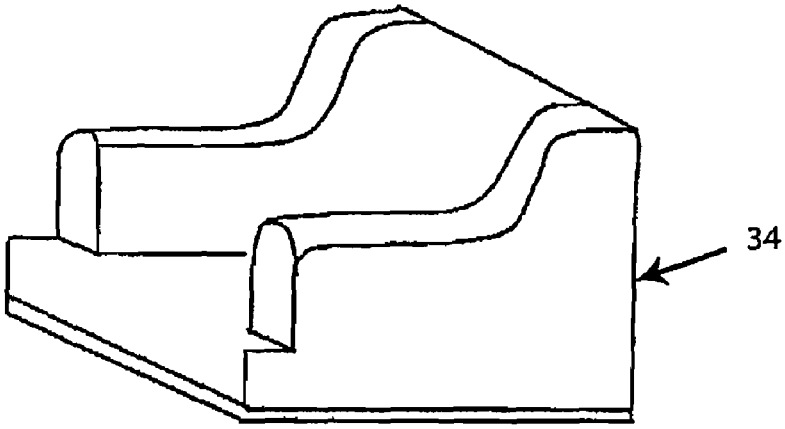
Figure 3E:
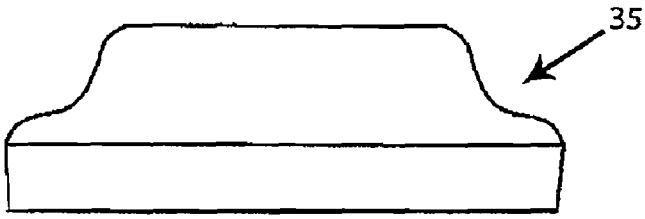
Figure 3F:
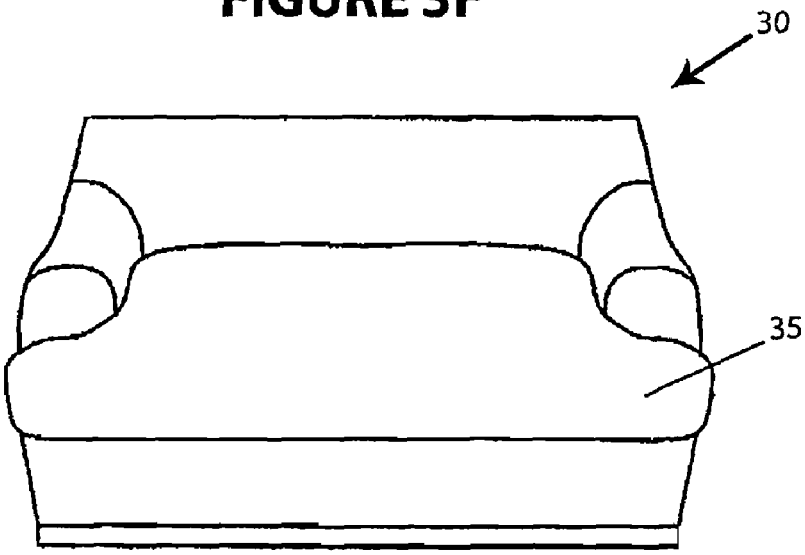
Figure 4:
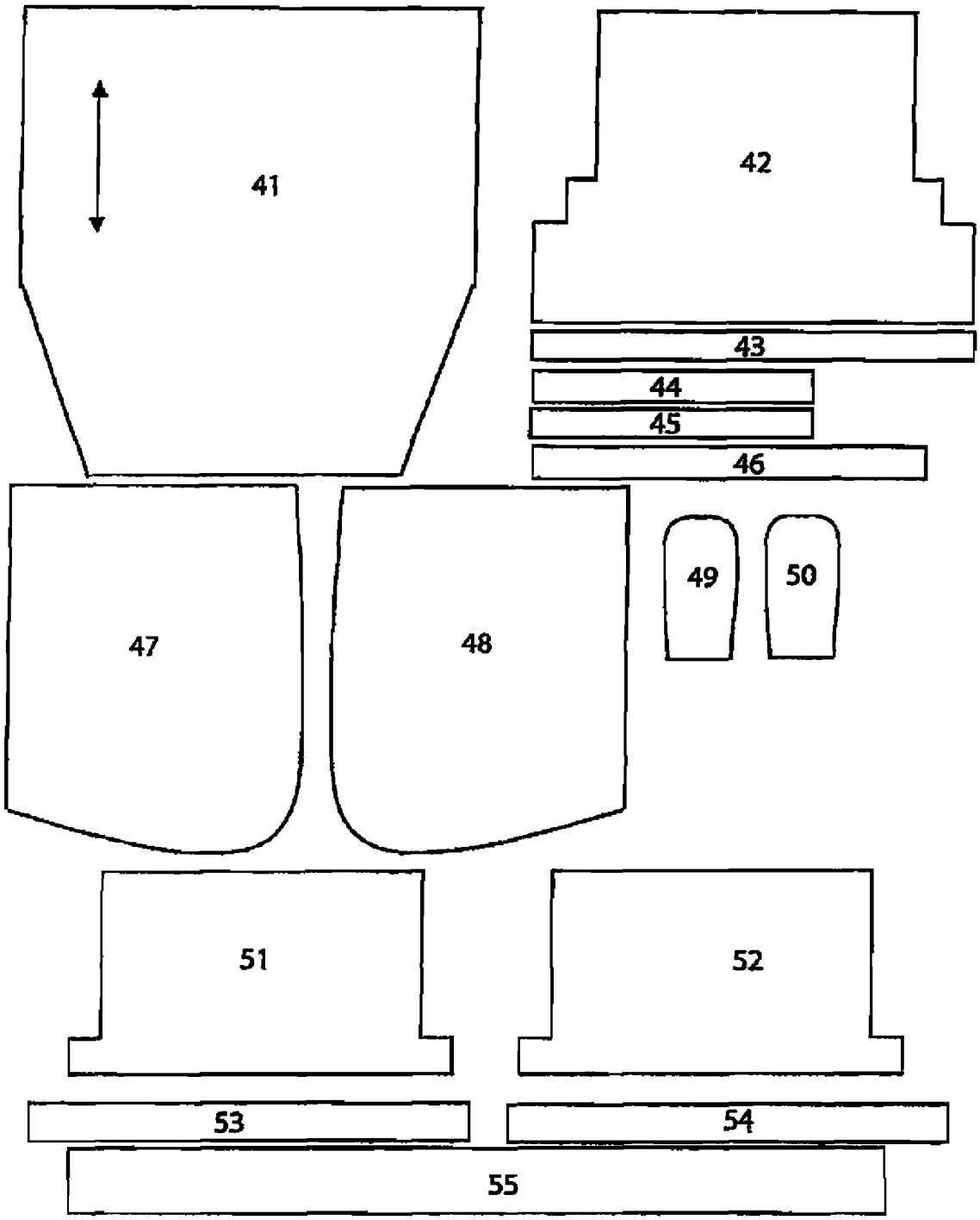
FIG. 4 is a plan view of the pattern components of the slipcover of FIGS. 3A through 3F.

The slipcover according to the first embodiment of the present invention is shown generally as slipcover 30 in FIGS. 3A through 3F, 4, and 5A through 5O, with FIGS. 3A through 3F illustrating the slipcover 30 being applied to the sofa 10 as depicted in FIGS. 1 and 2, FIG. 4 illustrating pattern components of the slipcover 30 of FIGS. 3A through 3F, and FIGS. 5A through 5O illustrating a sewing sequence for assembling the pattern components of FIG. 4 to manufacture the slipcover 30 of FIGS. 3A through 3F. As shown in FIG. 3A, the cushion (s) 18 are removed from the sofa (or alternatively, a loveseat or chair).

As shown in FIG. 3B, the slipcover 30 is applied over the top of the sofa 10, and then an elastic band 31 which is fixed at a lower opening of the slipcover 30 is placed at the base of the sofa 10. As shown in FIG. 3C, the arms of the slipcover 30 are set at points represented by reference numeral 32. The T-shape of the seat base of the slipcover 30 is then lined up over the T-shape of the sofa 10 at points represented by reference numeral 33. The back seams 34 of the slipcover 30 are then lined up at the back corners of the sofa 10, as shown in FIG. 3D.

As shown in FIG. 3E, the T-shaped seat cushion is covered with a separate cushion cover 35. Then as shown in FIG. 3F, the covered T-shaped seat cushion is set onto the base 12 of the sofa 10. Alternatively, there could be multiple seat cushions covered by the T-shaped seat cushion in place of the single seat cushion.

Figure 5A:
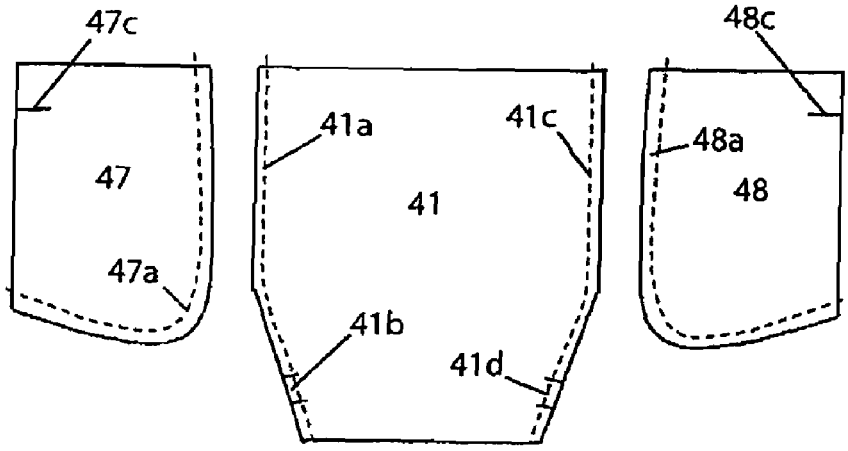
FIGS. 5A through 5O are plan views illustrating a sewing sequence for assembling the pattern components of FIG. 4 to manufacture the slipcover of FIGS. 3A-3F.

FIG. 4 is a plan view of the pattern components of the slipcover 30 of the first embodiment of the present invention. FIGS. 5A through 5O are plan views illustrating a sewing sequence for assembling the pattern components of FIG. 4 to manufacture the slipcover of FIGS. 3A through 3F.

Referring to FIG. 4, the pattern components include a back 41, seat platform 42, a front band, 43, two side bands, 44, 45, a back band 46, two arm sides 47, 48, two arm fronts 49, 50, two separate seat covers 51, 52, two separate seat zipper bands 53, 54, and a separate seat band 55. More specifically, the back 41 is similar to an upside-down gumdrop in shape with straight side edges and a flat, lower portion. The seat platform 42 is shaped similarly to a top-hat, but with an extra step. The front band 43, two side bands 44, 45 and back band 46 are each rectangular in shape, with the front band 43 and back band 46 being longer than the side bands 44, 45. Each of the two arm sides 47, 48 is essentially rectangular in shape on two sides and bowed in shape on the opposing two sides. The two arm fronts 49, 50 are gumdrop-shaped. The two separate seat covers 51, 52 are shaped like top-hats. The two separate seat zipper bands 53, 54 and the separate seat band 55 are each rectangular in shape, with the separate seat band 55 being wider and shorter than the seat zipper bands. It is understood that while specific shapes of the pattern components have been described, it is understood that modifications to the shapes and/or sizes of these pattern components may be made provided the components are still suitable for their intended purpose.

The process for assembling the pattern components of FIG. 4 to manufacture the slipcover 30 of the first embodiment will now be described with reference to FIGS. 5A through 5O.

Referring to FIG. 5A, the arm sides 47, 48 are sewn to the back 41. More specifically, one side of the arm sides 47 is sewn to one side of the back 41 along seams 41*a*, 47*a* and pleated back at notch 41*b*. Similarly, one side of the other arm side 48 is sewn to the other side of the back 41 along seams 41*c*, 48*a* and pleated back at notch 41*d*.

Figure 5B:
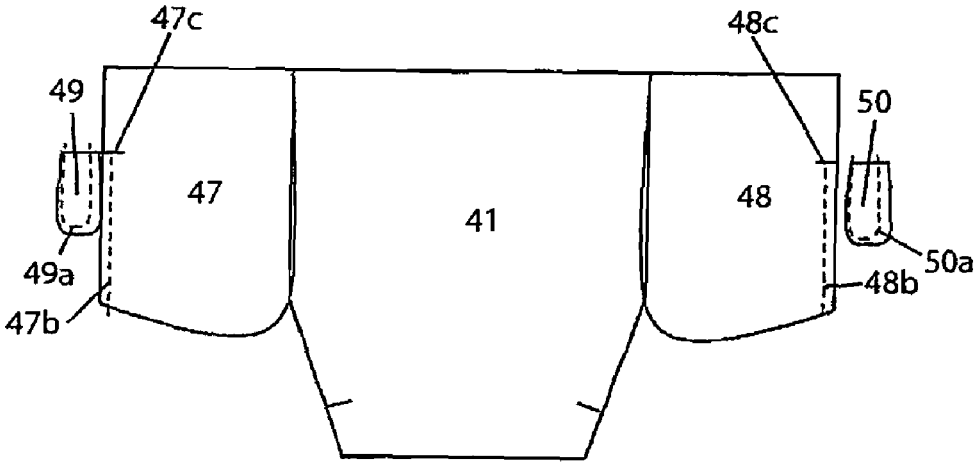

As shown in FIG. 5B, the arm fronts 49, 50 are then sewn to the respective arm sides 47, 48. More specifically, the arm front 49 is sewn to the arm side 47 along seams 49*a*, 47*b* from notch 47*c* to the end of the arm side 47. Similarly, but in the mirror image, the arm front 50 is sewn to the arm side 48 along seams 50*a*, 48*b* from notch 48*c* to the end of the arm side 48.

Figure 5C:
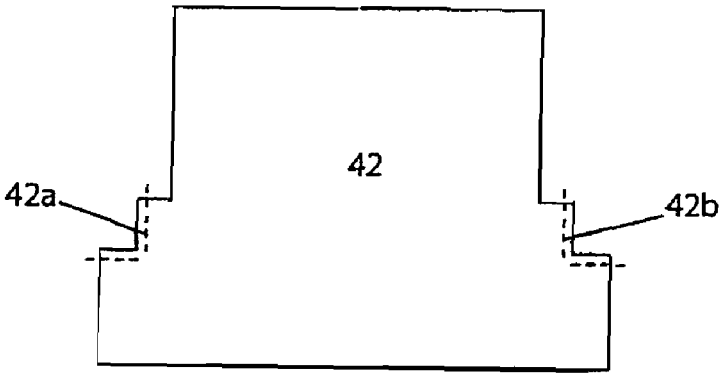
Figure 5D:
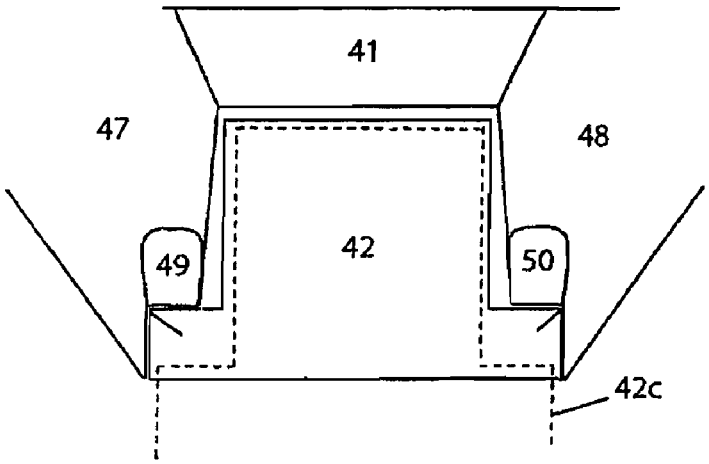

As shown in FIG. 5C, seams at corners of the seat platform 42 are joined to create a T-shape. More specifically, the seam 42*a* is joined at the corner, and the seam 42*b* is joined at another corner. As shown in FIG. 5D, the now T-shaped seat platform 42 is then joined to the arm sides 49, 50, arm fronts 47, 48, and the back 41 along seam 42*c*

Figure 5E:
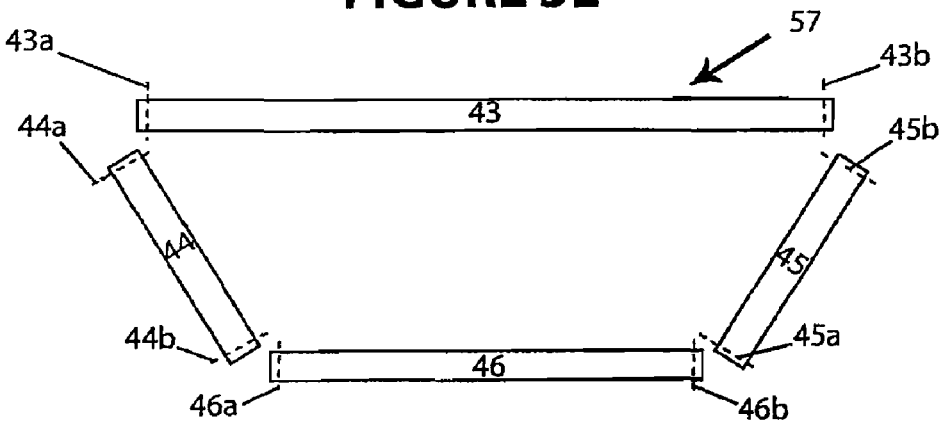

As shown in FIG. 5E, the back band 46, side bands 44, 45, and front band 43 are sewn together to form a complete band 57. More specifically, the front band 43 and the side band 44 are sewn along seams 43*a*, 44*a*, the side band 44 and the back band 46 are sewn along seams 44*b*, 46*a*, the back band 46 and the side band 45 are sewn along seams 46*b*, 45*a*, and the side band 45 and the front band 43 are sewn along seams 45*b*, 43*b*.

Figure 5F:
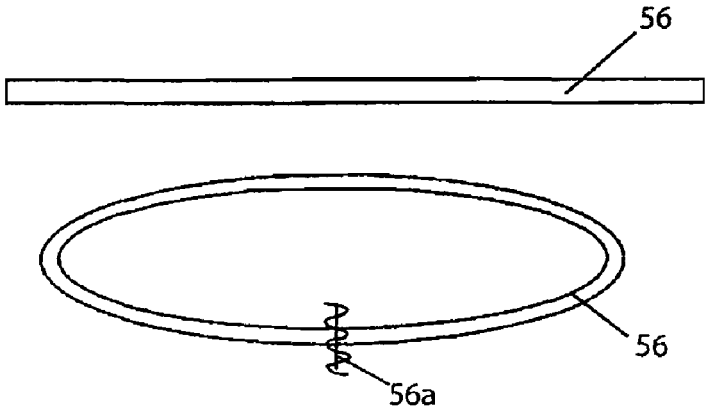
Figure 5G:
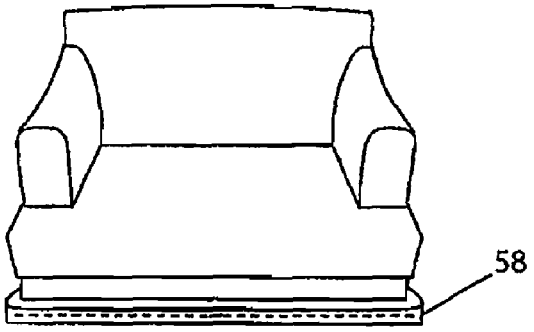
Figure 5H:
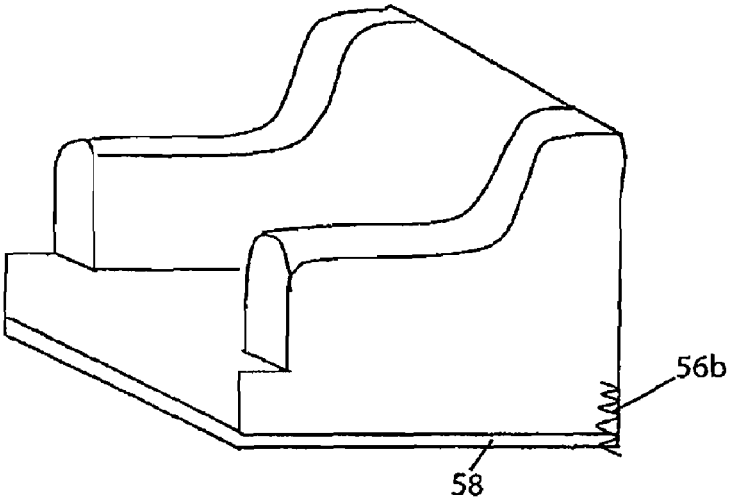

As shown in FIG. 5F, elastic 56 is cut to be half of the length of the complete band 57. The elastic properties are defined as preshrunk and able to stretch to a minimum of 150%. Then the ends of the elastic 56 are overlapped and bar-tacked at 56*a*. As shown in FIG. 5G, the elastic 56 is placed along the inner side of the band 57 and the combined elastic/band 58 is sewn to the bottom perimeter of the slipcover. As shown in FIG. 5H, the combined elastic/band 58 is then bar-tacked at 56*b* at the back side seam.

Figure 5I:
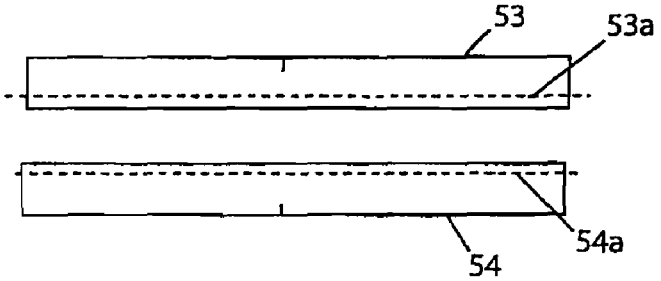
Figure 5J:
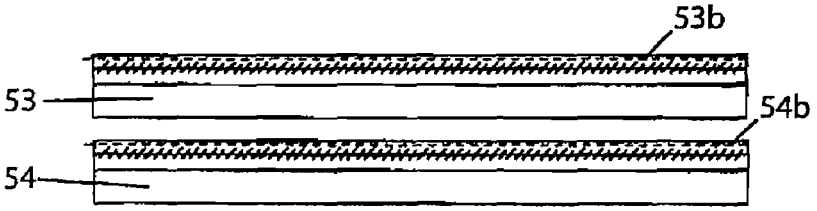
Figure 5K:
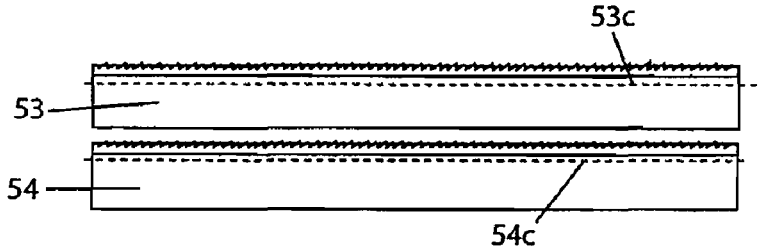
Figure 5L:
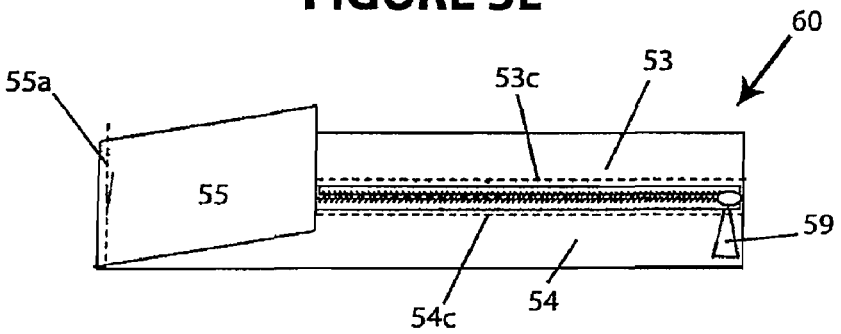
Figure 5M:
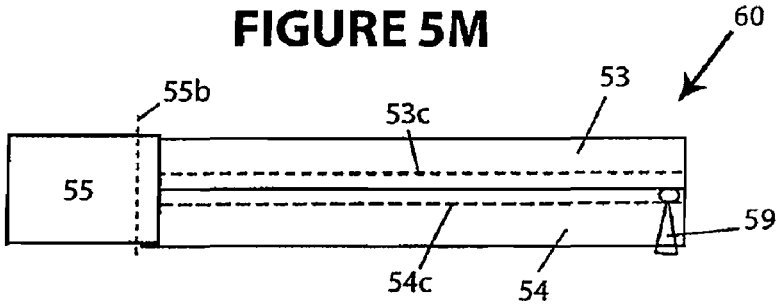
Figure 5N:
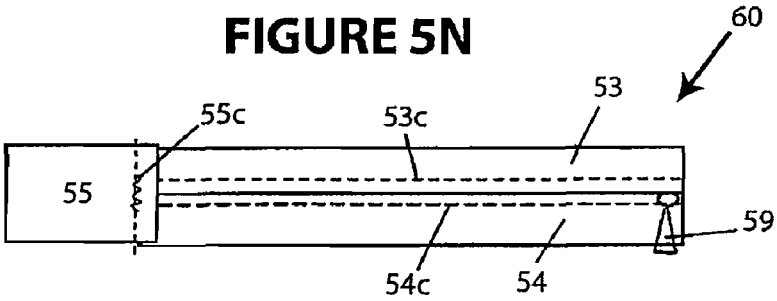
Figure 5O:
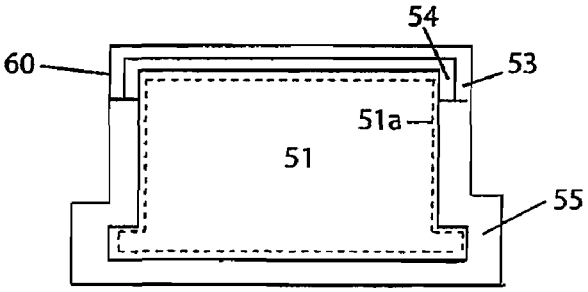

FIG. 5I shows that each of the separate zipper bands 53, 54 is edged. That is, separate zipper band 53 is edged at 53*a*, and separate zipper band 54 is edged at 54*a*. As shown in FIG. 5J, respective zipper halves 53*b*, 54*b* are then sewn to respective separate zipper bands 53, 54, and then as shown in FIG. 5K, each of the zipper halves 53*b*, 54*b* is top-stitched along lines 53*c*, 54*c*, respectively. FIG. 5L shows the zipper halves 53, 54 joined together with the addition of a zipper pull 59, this combination hereafter referred to as the zipper 60. Also, the separate seat band 55 is sewn to the zipper 60 along seam 55*a*. The separate seat band 55 is then flipped over toward the left to be flat with the zipper 60, and then a ¼" topstitch seam 55*b* is added. Finally, as shown in FIG. 5N, the separate seat band 55 is bar-tacked at 55*c* to the zipper 60 to reinforce this stress area. Similarly, the opposite end of the separate seat band 55 is sewn to the opposite end of the zipper band 54, topstitched, and bar-tacked.

As shown in FIG. 5O, the seat cushion cover is assembled. That is, the zipper 60 and the separate seat band 55 are sewn around the separate seat cover 51 at 51*a* on one side and the separate seat cover 52 (not shown) on the other side.

As discussed above, a significant feature of the slipcover of the first embodiment of the present invention is the ability of the slipcover to accommodate various dimensional ranges of furniture with T-shaped cushions. In this first embodiment this feature is accomplished through the specific stretch properties of the slipcover fabric and the design of the pattern. The slipcover therefore accommodates varied dimensional ranges of T-shaped cushion furniture, yet still provides a good fit.

According to a second embodiment of the present invention, the fitted slipcover base is specifically designed to fit a variety of furniture with box-shaped cushions. Specific attributes of box cushion furniture that are addressed within this design are two prominent seat depths, two prominent back heights, and varying arm heights and widths; all physical attributes of box cushion furniture sizing in comparison to T-shaped cushion furniture dimensions. Furthermore, the object is achieved with the design of a fitted box shaped cushion cover with zipper closure that is applied over the seat cushion(s) located on the furniture.

More specifically, the fitted slipcover has a base that is designed to fit a range of box cushion furniture bases allowing the slipcover to stretch over the largest perimeter of the furniture and then relax to the shape of the furniture with minimal tucking at the inside of the arm/back intersection. A fabric covered band with enclosed free-floating elastic holds the slipcover to the under side of the furniture. The arm front in a relaxed state fits narrow arm widths and dynamically stretches to fit wider arm widths. The fabric will also relax or stretch to accommodate a range of arm heights. The box shaped cushion cover can cover any number of cushions present on the furniture with one seat cover that form fits to the seat depth and width of the cushions via the dynamic stretch of the fabric.

Figure 6A:
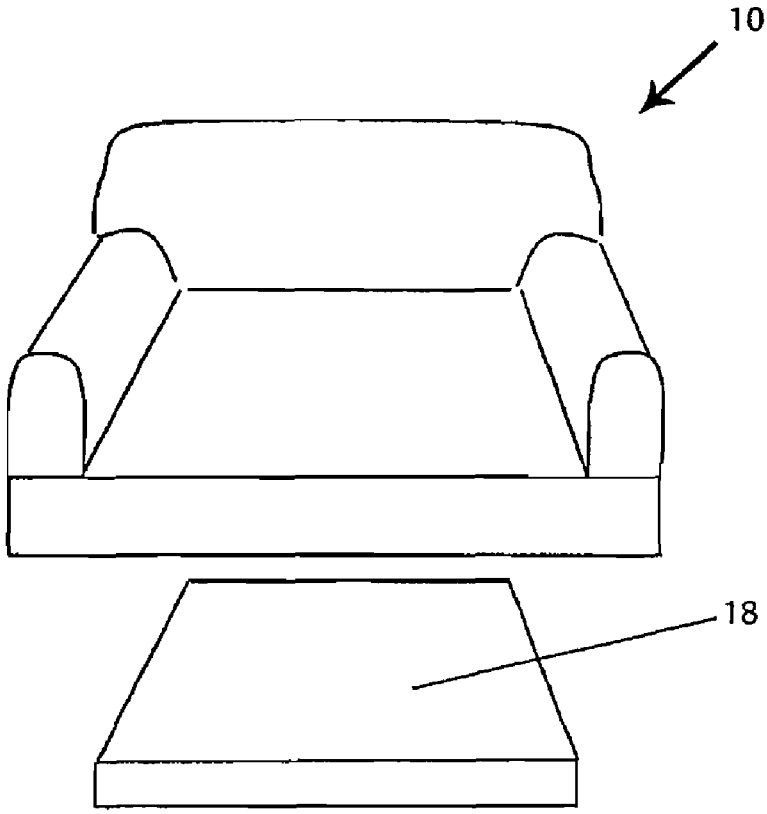
FIGS. 6A through 6E are perspective views of another slipcover with removable seat cushions being applied to the seating-type furniture illustrated in FIG. 1.
Figure 6B:
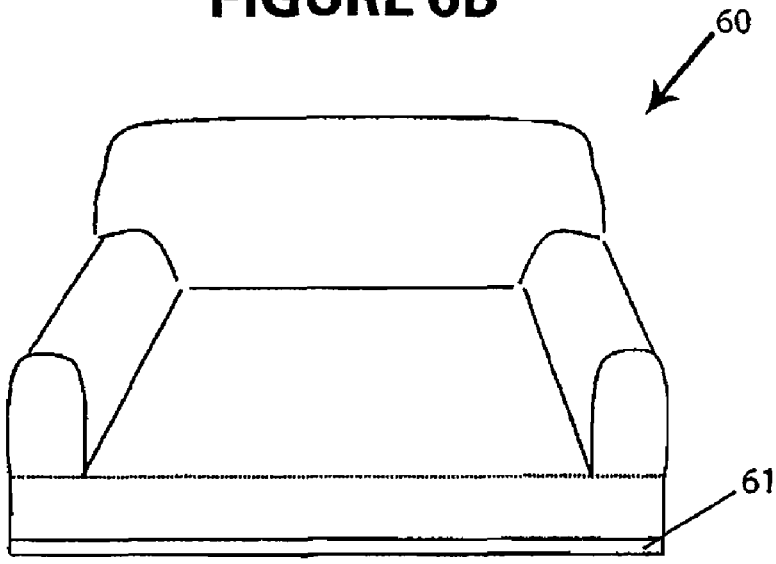
Figure 6C:
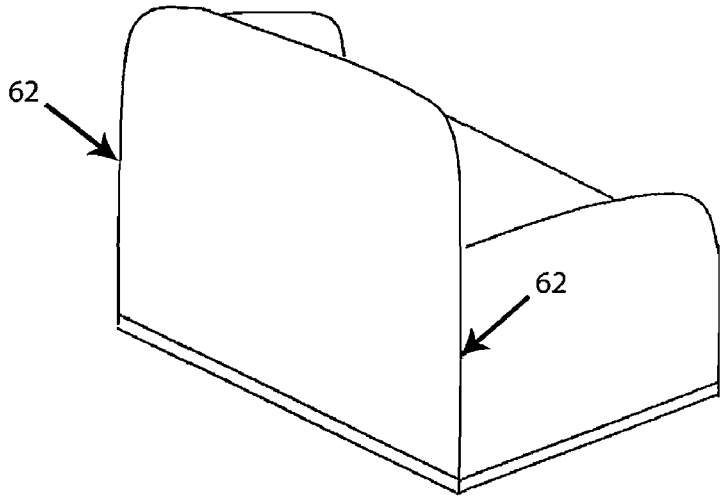
Figure 6D:
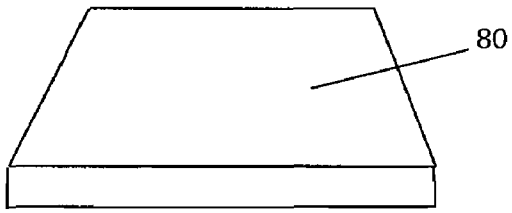
Figure 6E:
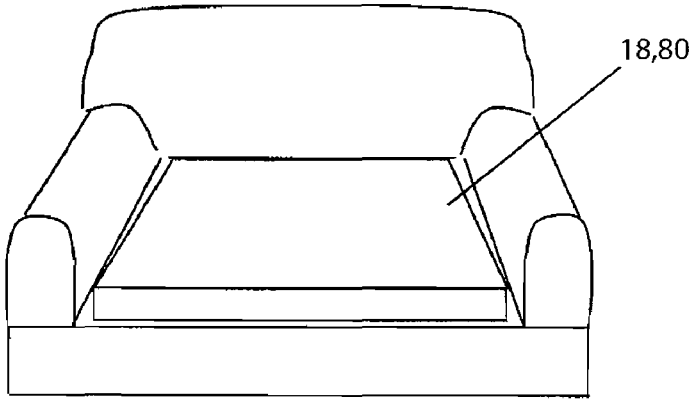
Figure 7:
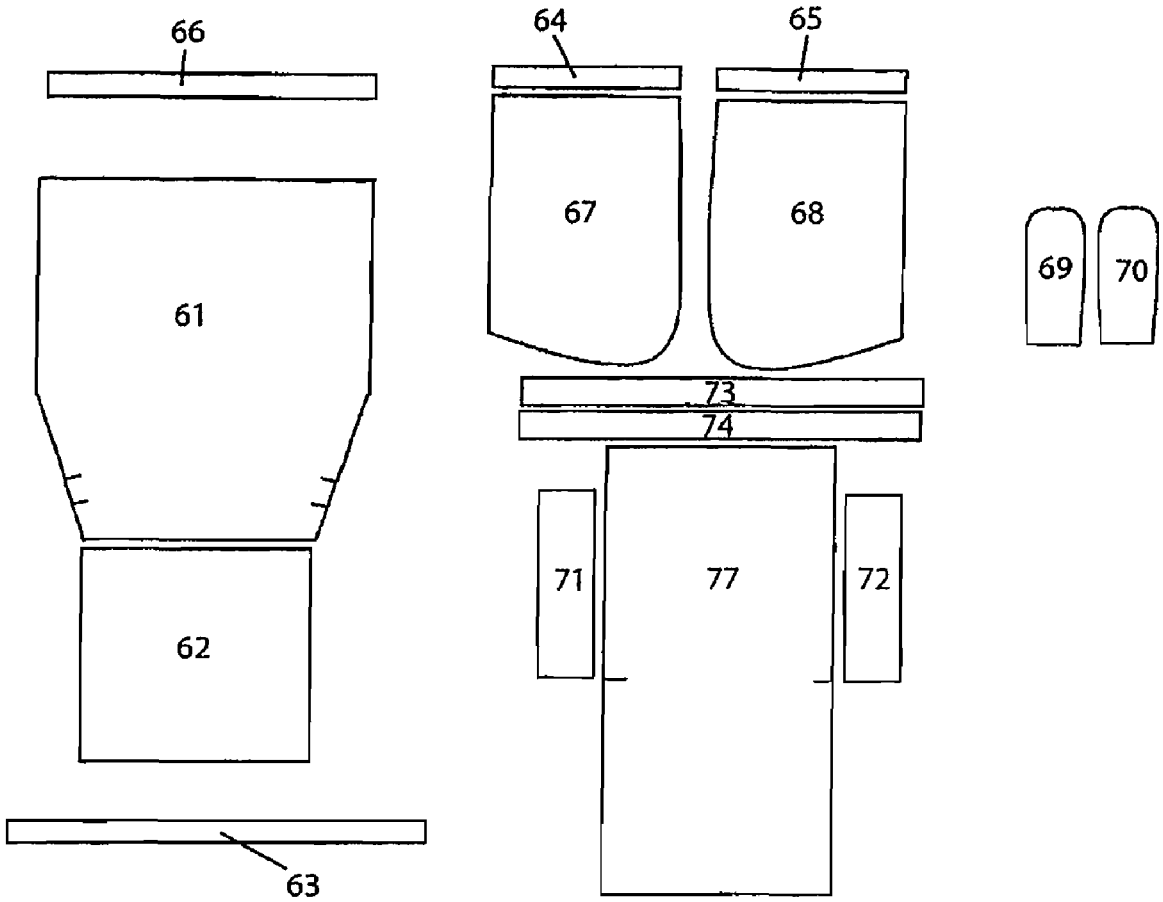
FIG. 7 is a plan view of the pattern components of the slipcover of FIGS. 6A through 6E.

The slipcover according to the second embodiment of the present invention is shown generally at 60 in FIGS. 6A through 6E, 7, and 8A through 8N, with FIGS. 6A through 6E illustrating the slipcover being applied to the sofa 10 depicted in FIGS. 1 and 2, FIG. 7 illustrating pattern components of the slipcover 60 of FIGS. 6A through 6E, and FIGS. 8A through 8N illustrating a sewing sequence for assembling the pattern components of FIG. 7 to manufacture the slipcover 60 of FIGS. 6A through 6E.

The slipcover 60 of the second embodiment is different from the slipcover 30 of the first embodiment in that its design is geared toward furniture having box-shaped rather than T-shaped cushion(s).

FIGS. 6A through 6E illustrate the slipcover 60 being applied to the sofa 10 illustrated in FIGS. 1 and 2. Although much of the application between the first and second embodiments is the same, a full description of the application of the slipcover 60 according to the second embodiment is nevertheless provided because the reference numerals are different.

As shown in FIG. 6A, the cushion 18 is removed from the sofa 10. As shown in FIG. 6B, the slipcover 60 is applied over the top of the sofa 10, and then an elastic band 61 is placed at the base of the sofa 10. Then, as shown in FIG. 6C, the back seams 62 of the slipcover 60 are lined up with the back corners of the sofa 10. Finally, the seat cushion 18 is covered with a separate cushion cover 80 (see FIG. 6D), and the covered seat cushion 18 with cover 80 is placed on the slip-covered sofa 10 (see FIG. 6E).

Figure 8A:
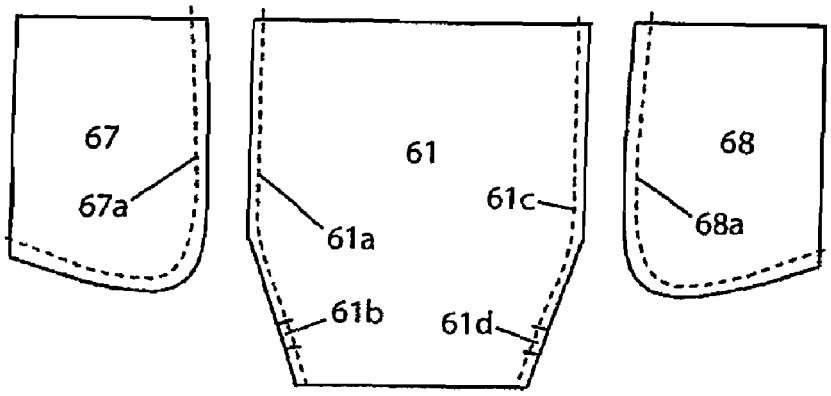
FIGS. 8A through 8N are plan views illustrating a sewing sequence for assembling the pattern components of FIG. 7 to manufacture the slipcover of FIGS. 6A through 6E.

FIG. 7 is a plan view of the pattern components of the slipcover 60 of the second embodiment of the present invention. FIGS. 8A through 8N are plan views illustrating a sewing sequence for assembling the pattern components of FIG. 7 to manufacture the slipcover of FIGS. 6A through 6E.

Referring to FIG. 7, the pattern components include a back 61, seat 62, front band 63, two side bands 64, 65, a back band 66, two arm sides 67, 68, two arm fronts 69, 70, two side seats 71, 72, two zipper bands 73, 74, and a seat cushion 77. More specifically, the back 61 is similar to an upside-down gumdrop in shape with straight side edges and a flat, lower portion. The front band 63, two side bands 64, 65, back band 66, seat 62, side seats 71, 72, and seat cushion 77 are each essentially rectangular in shape. Each of the two arm sides 67, 68 is essentially rectangular in shape on two sides and bowed in shape on the opposing two sides. The two arm fronts 69, 70 are gumdrop shaped. It is understood that while specific shapes of the pattern components have been described, it is understood that modifications to the shapes and/or sizes of these pattern components may be made provided the components are still suitable for their intended purpose.

The process for assembling the pattern components of FIG. 7 to manufacture the slipcover 60 of the second embodiment will now be described with reference to FIGS. 8A through 8S.

Referring to FIG. 8A, the arm sides 67, 68 are sewn to the back 61. One side of the arm sides 67 is sewn to one side of the back 61 along seams 61*a*, 67*a* and pleated back at notch 61*b*. Similarly, one side of the other arm side 68 is sewn to the other side of the back 61 along seams 61*c*, 68*a* and pleated back at notch 61*d*.

Figure 8B:
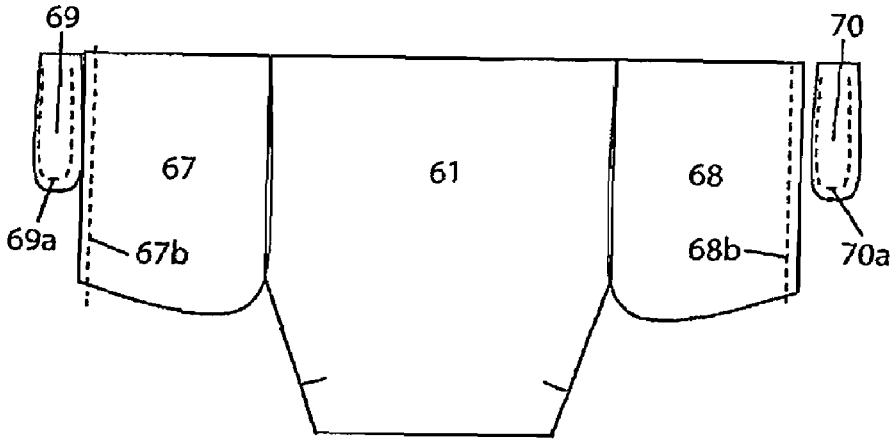

As shown in FIG. 8B, the arm fronts 69, 70 are sewn to the respective arm sides 67, 68. More specifically, the arm front 69 is sewn to the arm side 67 along seams 69*a*, 67*b* such that the flat portions of the arm front 69 and the back 61 are colinear. Similarly, but in the mirror image, the arm front 70 is sewn to the arm side 68 along seams 70*a*, 68*b* such that the flat portions of the arm front 68 and the back 61 are colinear.

Figure 8C:
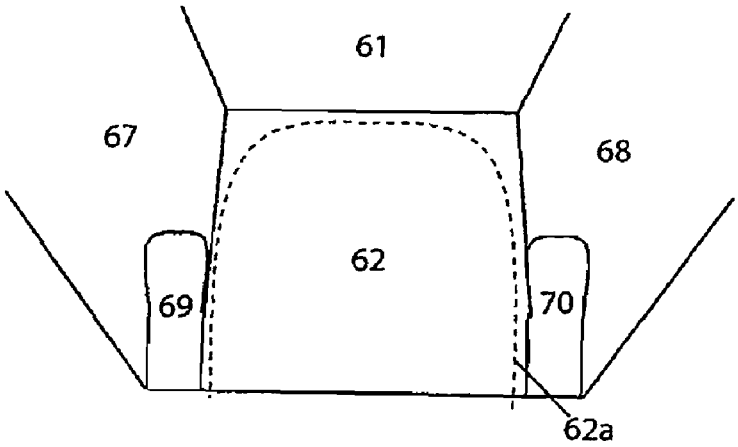

In FIG. 8C, the seat 62 is joined to the arm sides 69, 70, arm fronts 67, 68, and the back 61 along seam 62*a*.

Figure 8D:
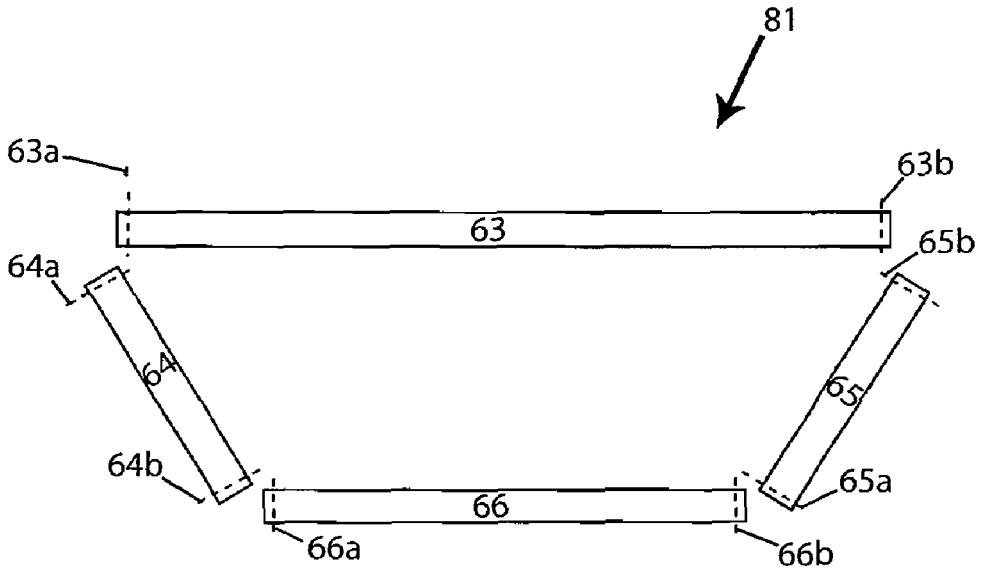

As shown in FIG. 8D, the back band 66, side bands 64, 65, and front band 63 are sewn together to form a complete band 81. More specifically, the front band 63 and the side band 64 are sewn along seams 63*a*, 64*a*, the side band 64 and the back band 66 are sewn along seams 64*b*, 66*a*, the back band 66 and the side band 65 are sewn along seams 66*b*, 65*a*, and the side band 65 and the front band 63 are sewn along seams 65*b*, 63*b*.

Figure 8E:
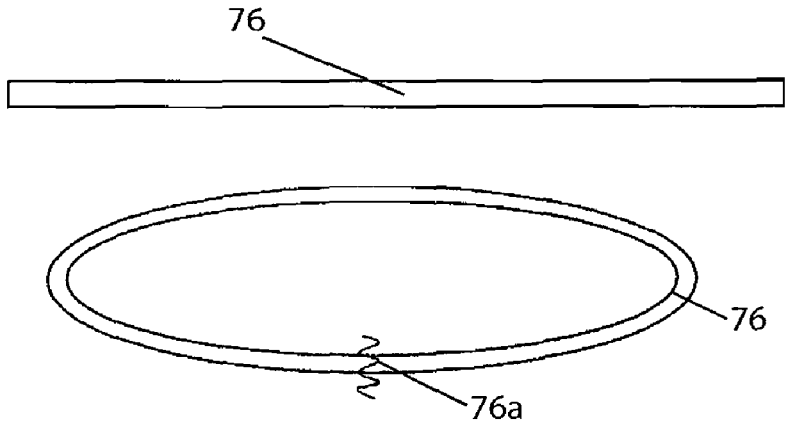
Figure 8F:
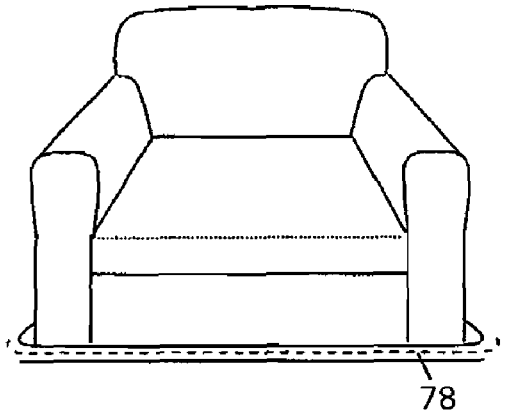
Figure 8G:
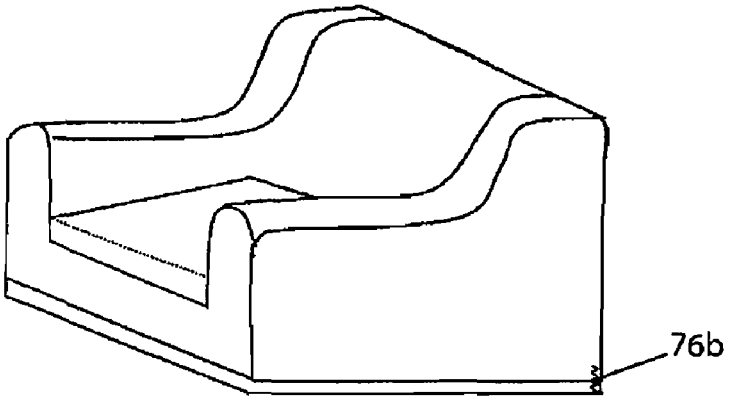

As shown in FIG. 8E, elastic 76 is cut to be half of the length of the complete band 81. Then the ends of the elastic 76 are overlapped and bar-tacked at 76*a*. As shown in FIG. 8F, the elastic 76 is placed along the inner side of the band 81 and the combined elastic/band 78 is sewn to the bottom perimeter of the slipcover. As shown in FIG. 8G, the combined elastic/band 78 is then bar-tacked at 76*b* at the back side seam.

Figure 8H:
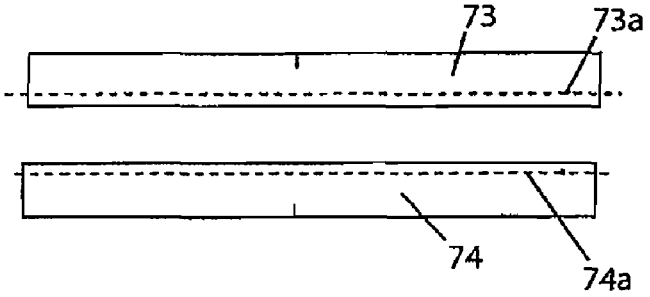
Figure 8I:
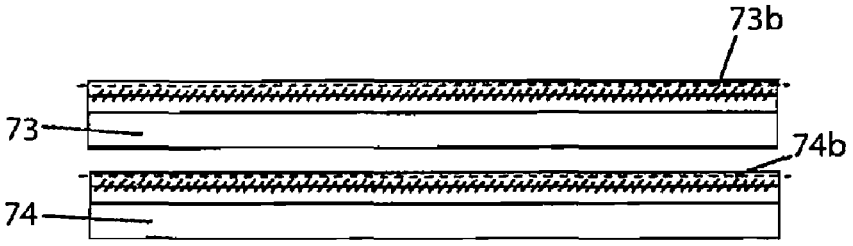
Figure 8J:
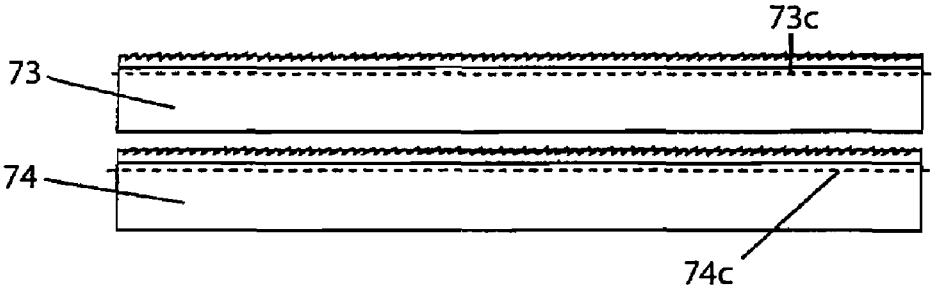
Figure 8K:
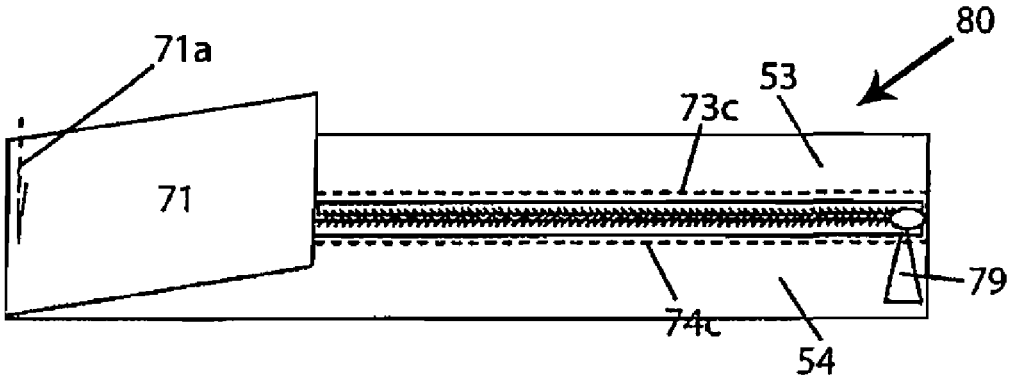
Figure 8L:
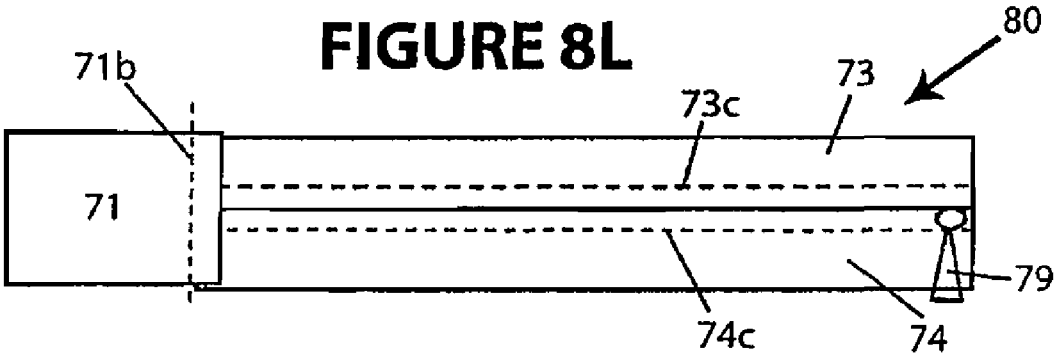
Figure 8M:
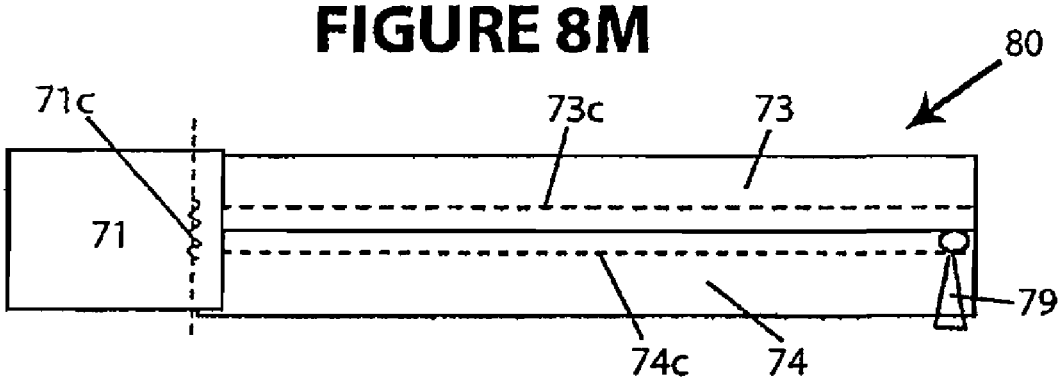
Figure 8N:
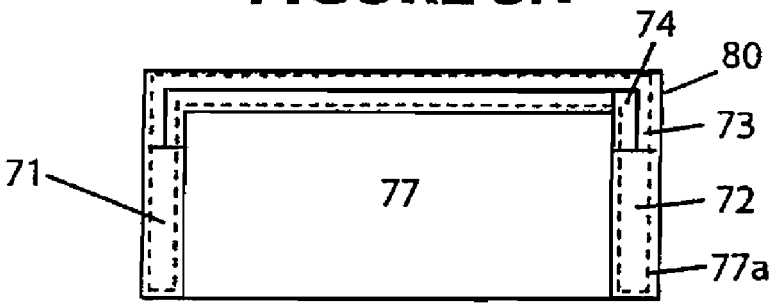
Figure 9:
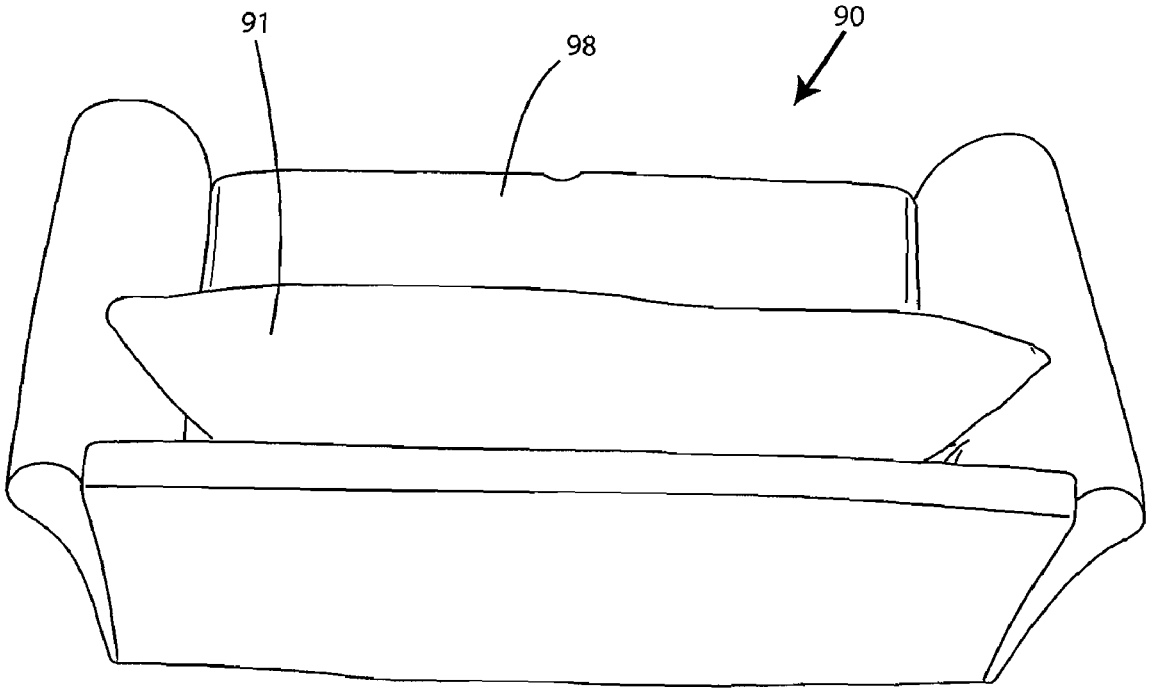
FIG. 9 is a perspective view of a three-piece knit form-fit slipcover according to the present invention having removable seat and back cushions, as fitted to a sofa, and as viewed from a rear elevation.
Figure 10:
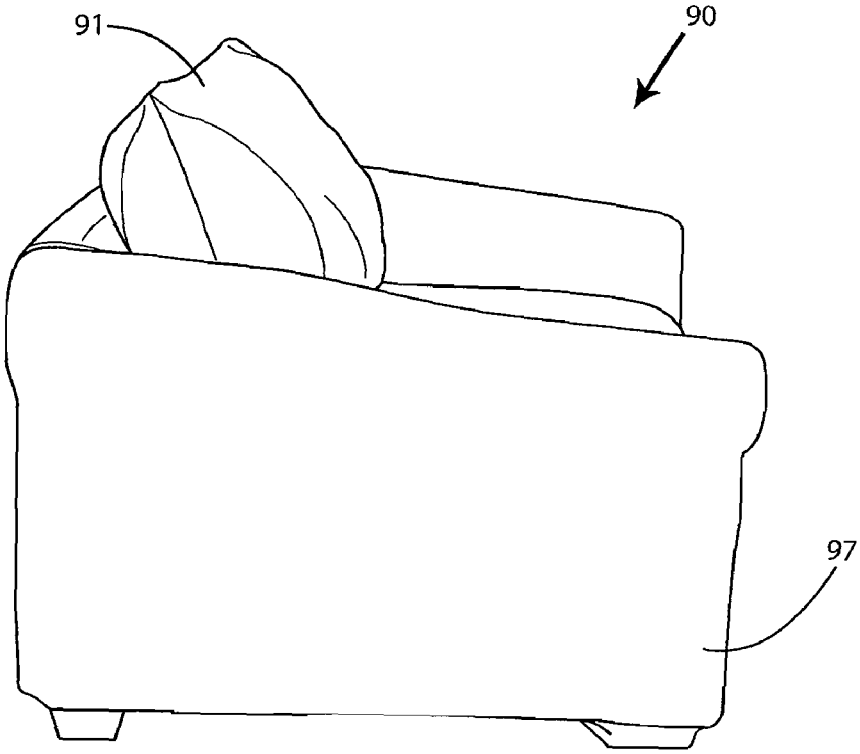
FIG. 10 provides a left elevation view of the slipcover of FIG. 9.
Figure 11:
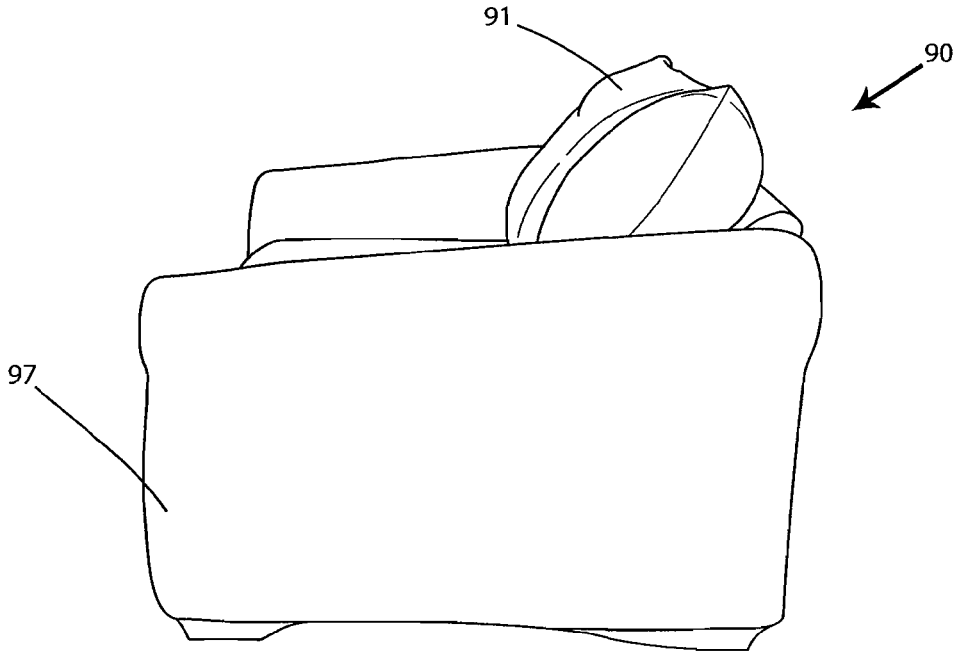
FIG. 11 provides a right elevation view of the slipcover of FIG. 9.
Figure 12:
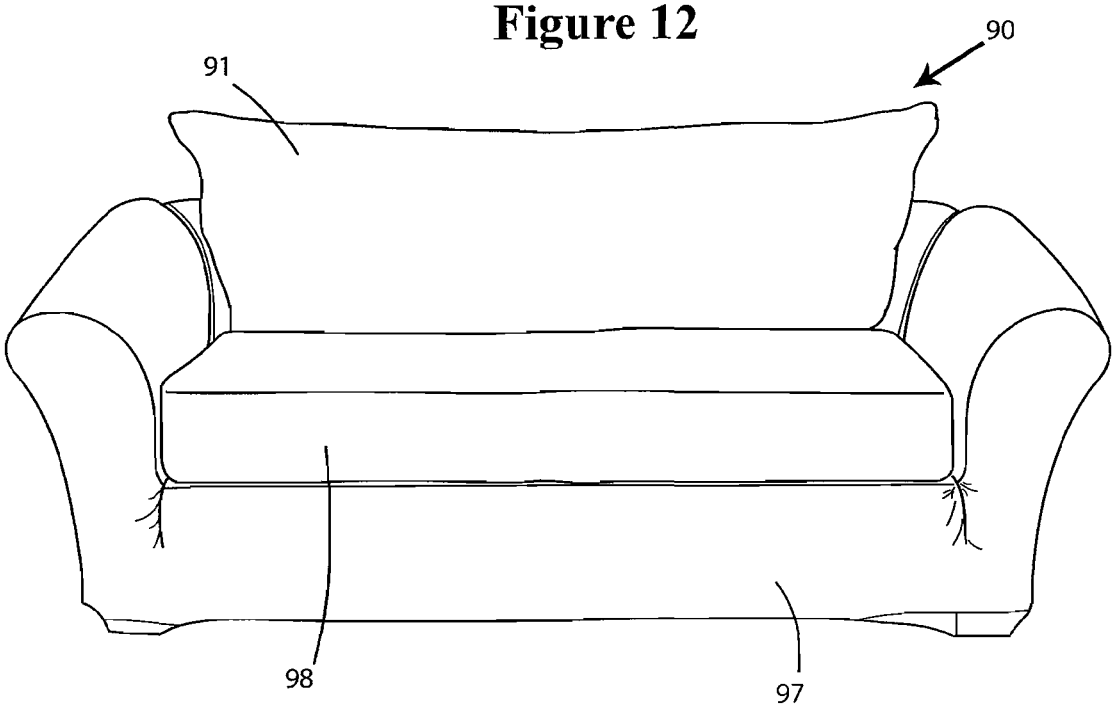
FIG. 12 provides a front elevation view of the slipcover of FIG. 9.
Figure 13:
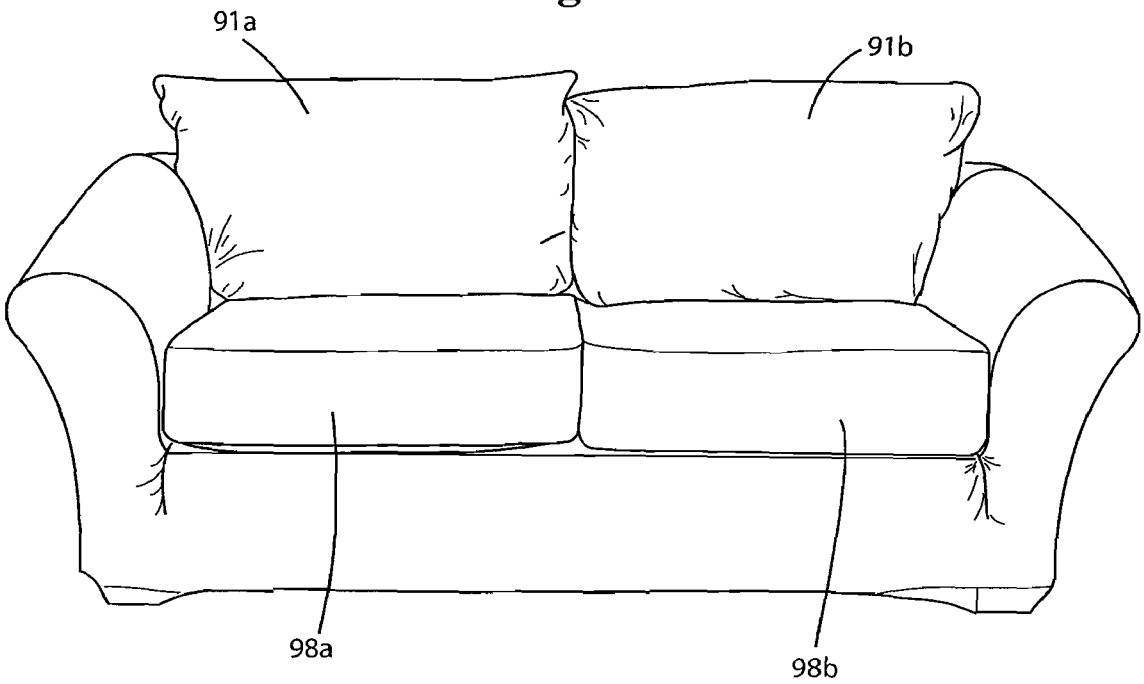
FIG. 13 provides a front elevation view of an alternative embodiment to the slipcover of FIG. 9, in which separate cushion covers each cover a pair of seat cushions and a pair of back cushions, respectively.

FIG. 8H shows that each of the separate zipper bands 73, 74 is edged. That is, separate zipper band 73 is edged at 73*a*, and separate zipper band 74 is edged at 74*a*. As shown in FIG. 8I, respective zipper halves 73*b*, 74*b* are then sewn to respective separate zipper bands 73, 74, and then as shown in FIG. 8J, each of the zipper halves 73*b*, 74*b* is top-stitched along lines 73*c*, 74*c*, respectively. FIG. 8K shows the zipper halves 73, 74 joined together with the addition of a zipper pull 79, this combination herein after referred to as the zipper 80. Also, the seat band 71 is sewn to the zipper 80 along seam 71*a*. As shown in FIG. 8L, the seat band 71 is then flipped over toward the left to be flat with the zipper 80, and then a ¼" topstitch seam 71*b* is added. Finally, as shown in FIG. 8M, the seat band 71 is bar-tacked to the zipper 80 to reinforce this stress area. Similarly, the opposite end of the separate seat band 72 is sewn to the opposite end of the zipper band 74, topstitched, and bar-tacked.

As shown in FIG. 8N, the seat cushion cover is assembled. That is, the zipper 80 and the two side seats 71, 72 are sewn around half of the seat cushion 77 (shown) and the other half of the seat cushion 77 (not shown).

As discussed above, a significant feature of the slipcover of the present invention according to the second embodiment is the ability of the slipcover to accommodate various dimensional ranges of furniture with box-shaped cushions. In this second embodiment this feature is accomplished through the specific stretch properties of the slipcover fabric and the design of the pattern. The slipcover therefore accommodates varies dimensional ranges of box-shaped cushion furniture, yet still provides a good fit.

The slipcover has been described as being applicable to a sofa, it is understood that the slipcover may be applied to any seating-type furniture having a base, a back, and generally a seat cushion, though a seat cushion is not a requirement. The slipcover patterns may been designed for chair widths of, for example, 32"-43", love seat widths of, for example, 58"-73", and sofa widths of, for example, 74"-96".

A third embodiment of the present invention comprises a slipcover 90 having a base cover that includes a variety of panels which are assembled to provide a back portion, a seat portion, and right and left armrest portions. In addition to the base cover, one or more seat cushion covers are provided to cover one or more seat cushions, and one or more back cushion covers are provided to cover one or more back cushions.

Figure 14:
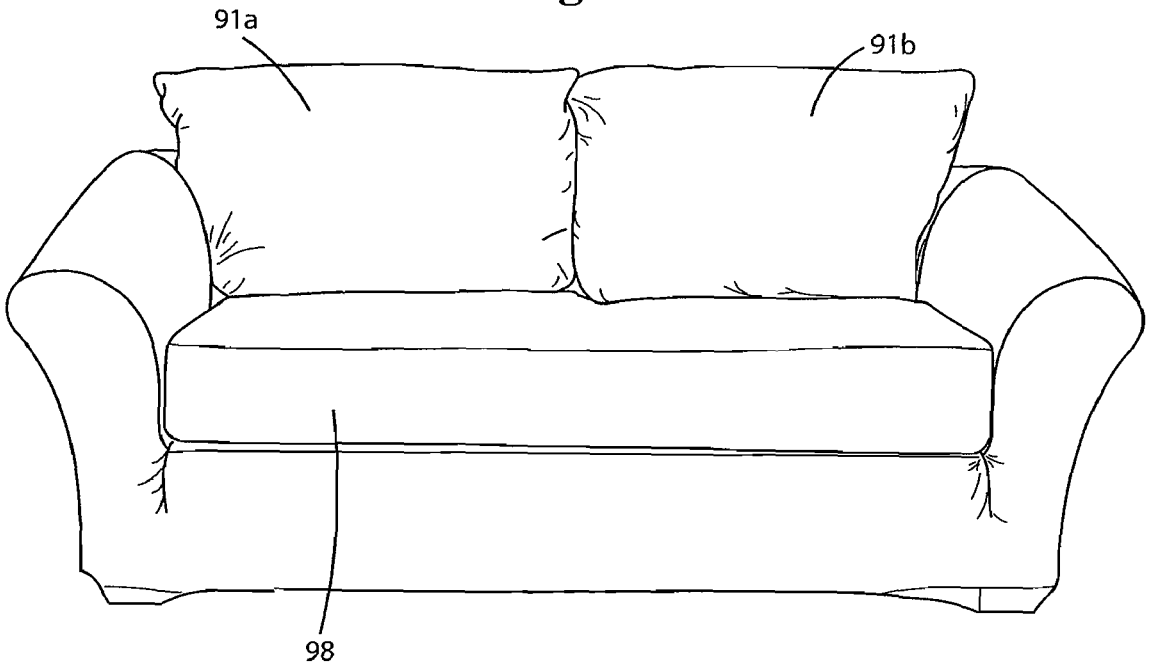
FIG. 14 a front elevation view of an alternative embodiment to the slipcover of FIG. 9, in which separate cushion covers cover a pair of back cushions and a single seat cushion cover covers a pair of seat cushions.
Figure 15:
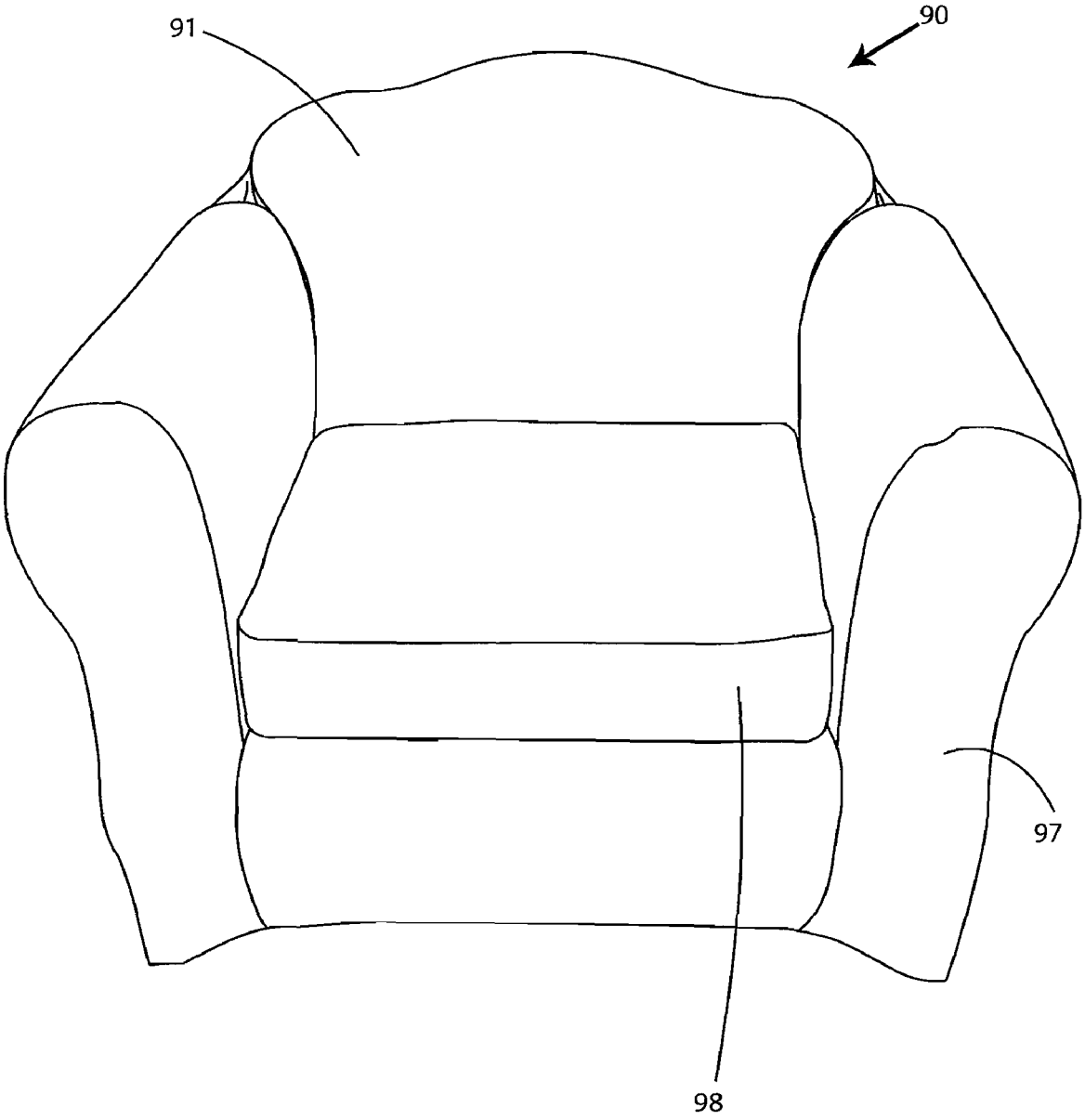
FIG. 15 a front elevation view of an alternative embodiment to the slipcover of FIG. 9 for covering a chair, in which the slipcover includes a base cover, a single seat cushion cover and a single back cushion.

In the embodiment illustrated in FIGS. 9 through 12 and 15, a single seat cushion cover 98 covers two seat cushions and a single back cushion cover 91 covers two back cushions. Alternatively, as illustrated in FIG. 14, two back cushion covers 91*a* and 91*b* may be used for individually covering the two back cushions. As illustrated in FIG. 14, two back cushion covers 91*a* and 91*b*, and two seat cushion covers 98*a* and 98*b*, may be used to individually cover two back cushions and two seat cushions, respectively. Additional embodiments of the present invention contemplate any and all configurations having one or more seat cushion covers and one or more back cushion covers, including those in which each seat cushion cover covers one or more seat cushions and/or each back cushion cover covers one or more back cushions. For example, FIG. 15 illustrates a slipcover 90 for covering a chair, including a base cover 97, a single seat cushion cover 98 for covering a single seat cushion and a single back cushion 91 for covering a single back cushion.

Figure 16:
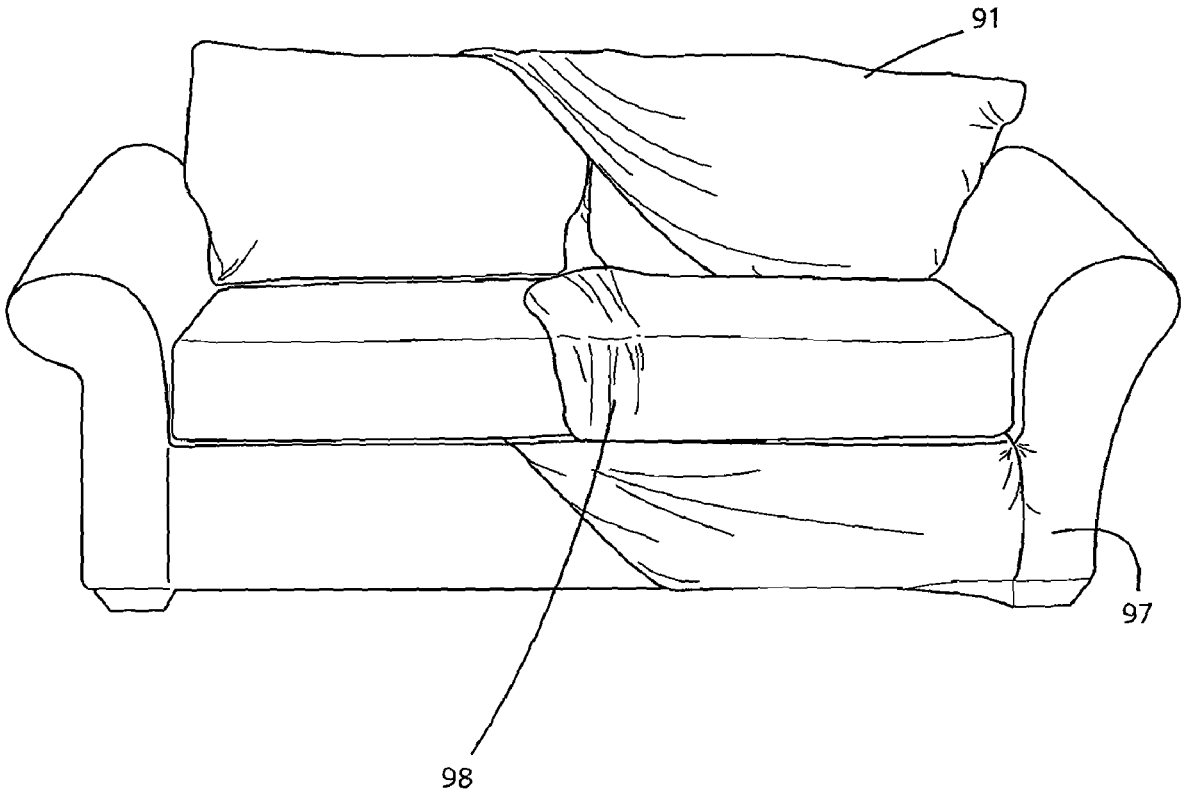
FIG. 16 provides another front elevation view of the slipcover as depicted in FIG. 9, in which the separate covers for the base, two seat cushions and two back cushions are partially installed on the sofa.

FIG. 16 illustrates a base cover 97, a seat cushion cover 98 and a back cushion cover 91 each partially installed over a love seat having a two seat cushions and two back cushions. In FIG. 16, the base cover 97, seat cushion cover 98 and back cushion cover 91 are respectively stretched over a base portion of the love seat, the seat cushions and the back cushions. The covers may for example be formed from the previously-described elasticized fabric having a stretch in length and a stretch in width which behave dynamically with respect to each other, so that the covers are able to stretch over the base, seat cushion and back cushion to achieve a form fit with the base, seat cushion and back cushion.

As previously described, the elasticized fabric is formed such that a minimum stretch in fabric width is 60%, and a minimum stretch in fabric length is 40%. A slipcover is form-fit to the furniture when the stretch in fabric width is 60% is reduced by 10%, and the stretch in fabric length is 40% is reduced by 25%. The slipcover fabric preferably has a minimum of 5% spandex or other suitable elastic fiber. As previously described, a suitable testing method used to measure the stretch properties of the slipcover fabric is outlined in the ASTM reference manual as ASTM D 2594.

Figure 17A:
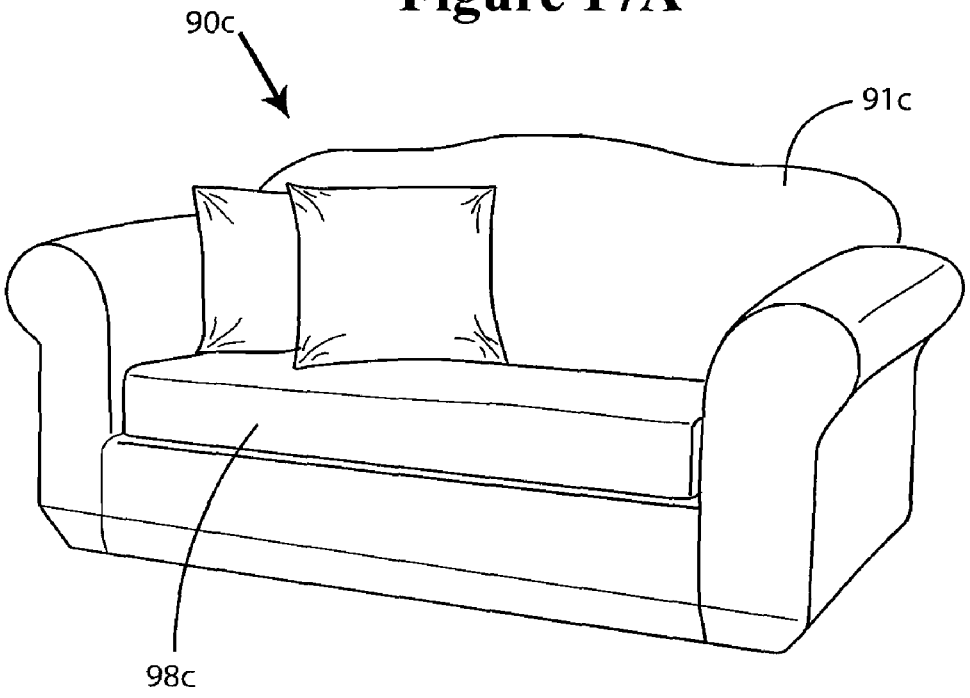
FIG. 17A provides a perspective view of the slipcover of FIG. 9, while FIG. 17B provides a front elevation view of an alternative embodiment in which the seat cushion cover is applied to seat cushions configured in a "T-cushion" arrangement.
Figure 17B:
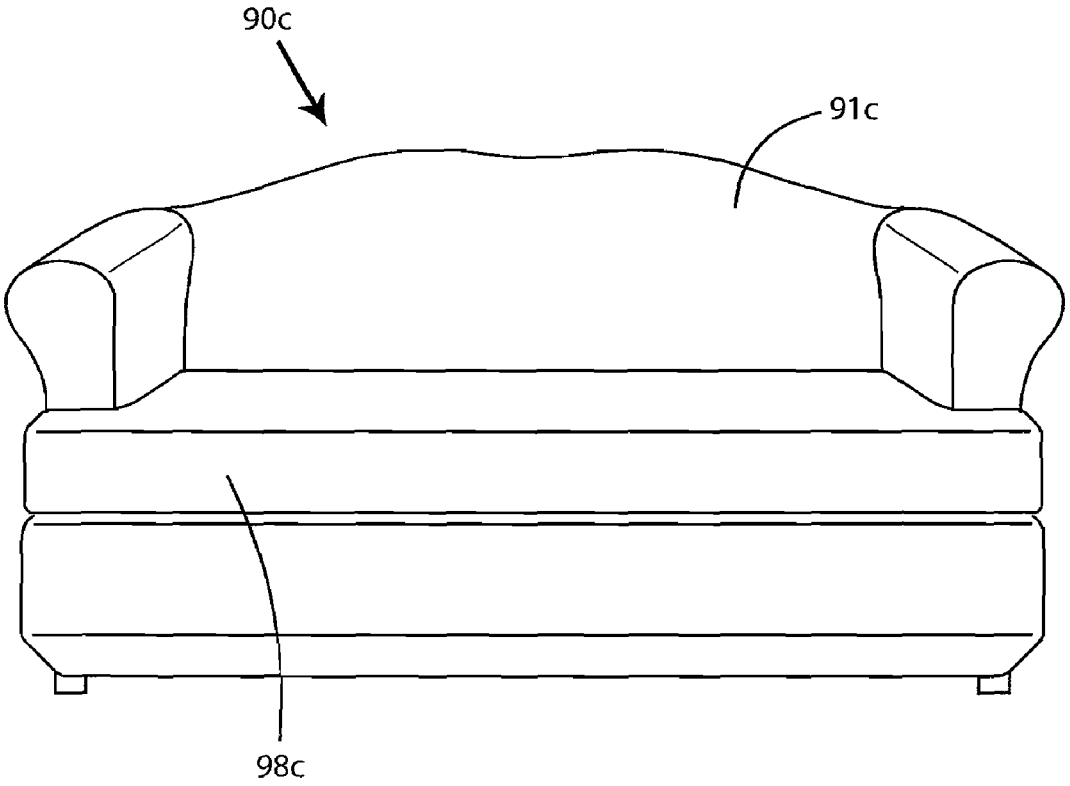

A variety of slipcover configurations are contemplated within the scope of the present invention. For example, FIG. 17A illustrates a sofa covered by the inventive slipcover 90*c*, the slipcover 90*c* including a single seat cushion cover 98*c* for covering two box-shaped seat cushions and a single back cushion cover 91*c* for covering one or more back cushions that extend over the armrests. FIG. 17B illustrates a sofa having a single T-shaped seat cushion cover 98*c* for covering one or more cushions which together define a T-shape, and a single back cushion cover 91*c* for covering one or more back cushions extending essentially up to and not over the armrests.

FIGS. 17A and 17B also illustrate how two differently-shaped pieces of furniture may be accommodated by a single slipcover design produced according to the principles of the present invention. For example, the furniture piece covered by the slipcover 90*c* of FIG. 17A has arms which are wider and of a lesser height that the arms of the furniture piece covered by the slipcover 90*c*of FIG. 17B.

As described above, the inventive slipcover 90 comprises a fabric capable of a stretch in length and a stretch in width which behave dynamically with respect to each other. In other words, when extended to a greater degree in one direction (for example, to accommodated the greater height of the arms of the furniture piece depicted in FIG. 16A, the fabric remains taught when stretched to a lesser degree in the other direction (i.e., the direction of arm width in the furniture piece depicted in FIG. 16A). When stretched to a lesser degree in the height direction (i.e., as when applied to the furniture piece of FIG. 16B having arms of shorter height), the fabric is able to stretch to a greater degree in the width dimension.

Applicant discovered a mechanism for characterizing a series of "common denominator" features of furniture pieces in order to associate a variety of furniture shapes and designs with a particular pattern design for the inventive slipcover. For example, Applicant discovered that furniture pieces were commonly designed with one of two seat depths: a 23" depth for furniture with integrally padded backs, and a 27" depth for unpadded furniture backs fitted with removable back cushions. Seat panels could therefore be fashioned to be form-fit by being sized to be stretchable between these two depths.

Applicants further discovered, for example, that furniture designs limited arm heights to a maximum of 25" when arm widths were no greater than 14", and limited arm widths to no more than 9" when arm heights extended to 30". Applicants found, for example, that a single design arm panel design could be sized to be stretchable between these two extremes.

Figure 18:
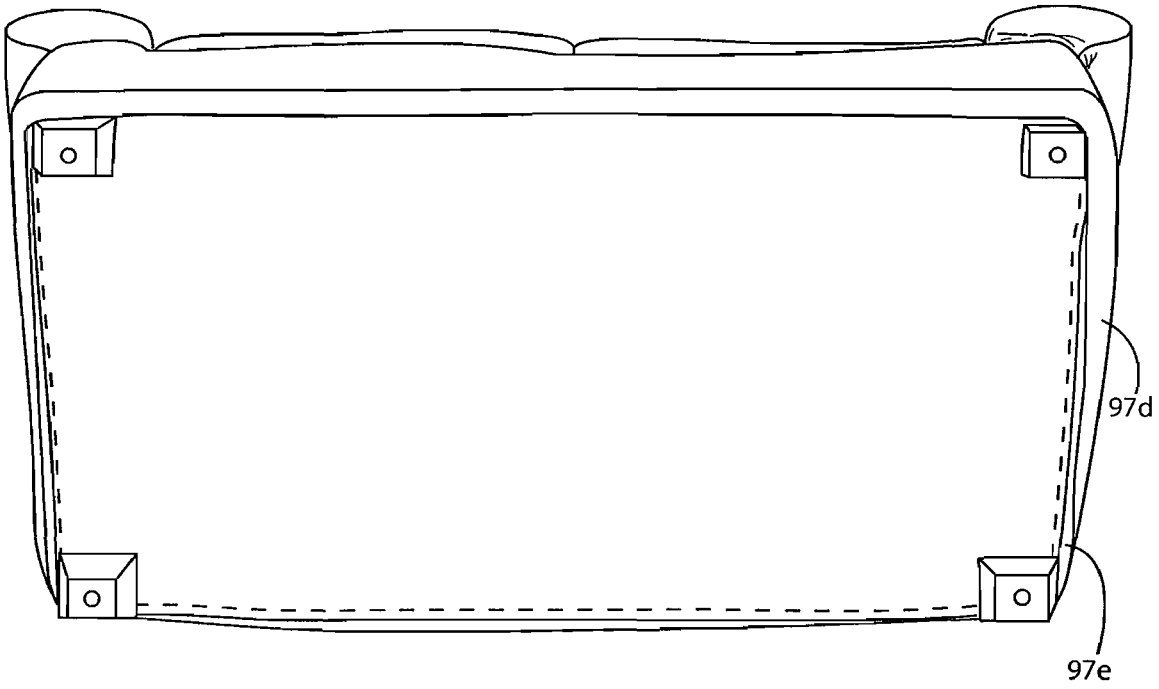
FIG. 18 illustrates a fabric-covered elastic, which is attached at the bottom of a skirt portion the slipcover of FIG. 9.

FIG. 18 illustrates an fabric-covered elastic 97*e*, which is attached at the bottom of a skirt portion 97*d* of the base cover 97 so that the skirt portion 97*d* can be stretched over the base of the furniture and retained at a bottom surface of the base. This enables the skirt portion to achieve a form fit with the lower front, back and side surfaces of the base of the furniture.

The fabric-covered elastic 97*e* may be secured, for example, by sewing the elastic directly to a perimeter edge at the bottom of the skirt portion 97*d*. Alternatively, the perimeter edge may be sewn to form a tube for carrying the elastic freely around this edge. The elastic may be comprise a single, continuous piece that traverses the entire perimeter, or may include multiple pieces which may be snugged and tied off at various positions around the edge (for example, at corner positions to be secured to the furniture legs), or otherwise fastened by one or more of a variety of conventional fastening systems (for example, by a fabric hook-and-loop fastener such as a VELCRO fastener) at one or more tie-off points around the perimeter edge.

While the above-described features have been presented for the purpose of understanding preferred embodiments of the present invention as illustrated in FIGS. 9 through 18, it should be understood that some of these features may be further modified to produce other embodiments of the slipcover that remain within the intended scope of the present invention. For example, the skirt portion of base cover may be further modified for decorative purposes to include one or more panels of non-stretch fabric including gathers and/or other fit adjusting features. In addition, seat and back cushion covers may be more particularly configured to fit other cushion configurations.

Methods for assembling and applying the inventive seat cover are next described.

Figure 19A:
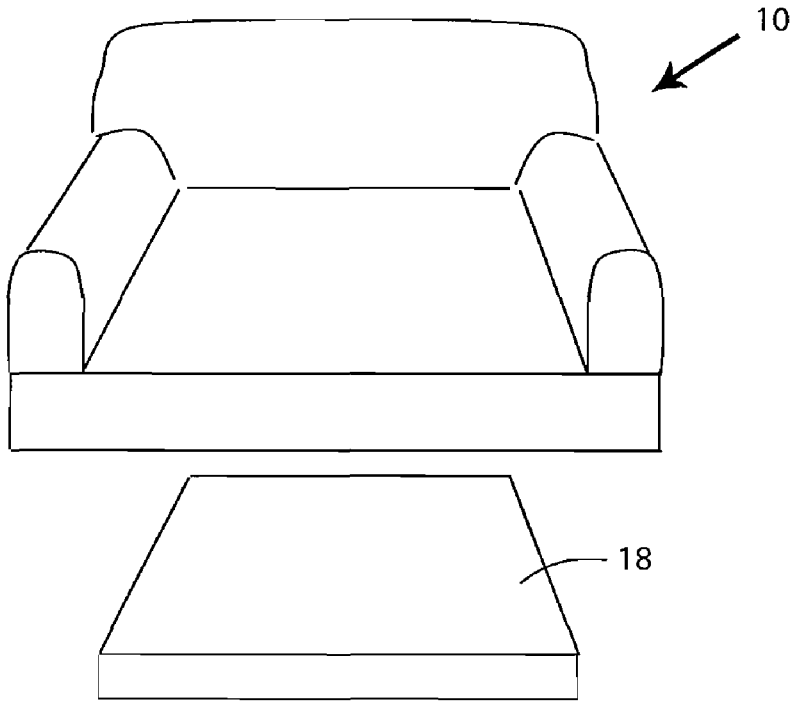
FIGS. 19A through 19E illustrate a method for applying the base cover of the slipcover of FIG. 9 to a furniture piece.
Figure 19B:
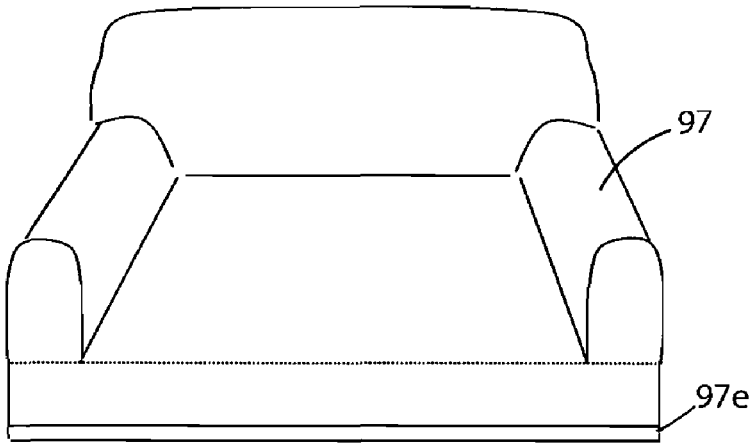

FIGS. 19A through 19E illustrate a method for applying the base cover of the inventive slipcover to a furniture piece 10. In FIG. 19A, an unattached seat cushion 18 is removed from the furniture piece 10. In FIG. 19B, the base cover 97 of the slipcover 90 is applied at the top of the furniture piece, and stretched and extended downwardly to cover the furniture piece. The elastic band 97*e* (for example, a fabric-covered elastic) that is secured at a bottom edge of the base cover 97 is stretched to the bottom edge of a lower frame of the furniture piece (or, alternatively, over the bottom edge of the lower frame).

Figure 19C:
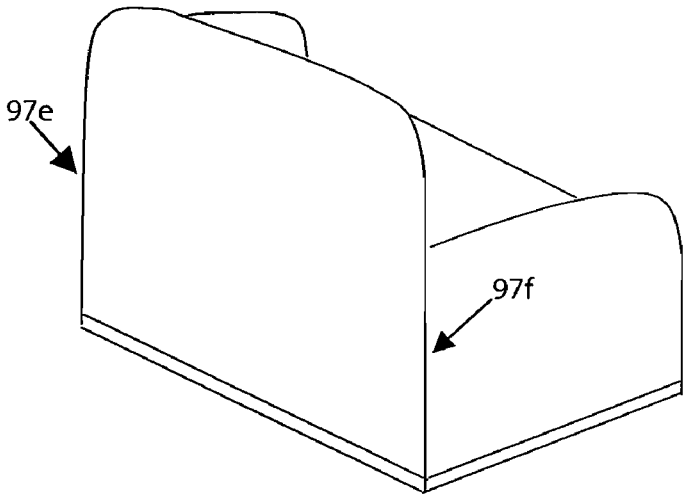
Figure 19D:
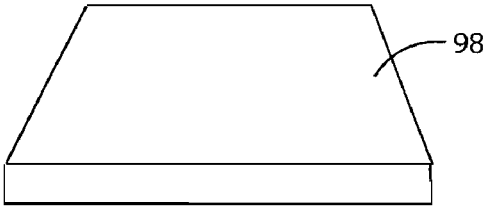
Figure 19E:
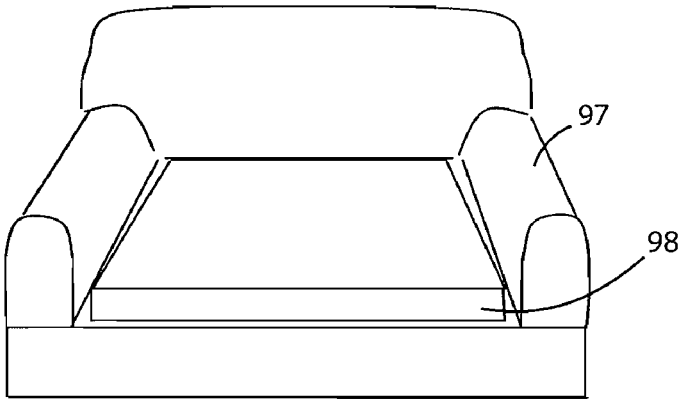

In FIG. 19C, placement of the base cover over the furniture piece is adjusted (for example, by lining up back seams 97*f* in the base cover 97 with back corner portions of the furniture piece). As illustrated in FIG. 19D, the separate seat cushion cover 98 is applied to a square seat cushion. Alternatively, the seat cushion cover 98 may be applied to a seat cushion having a different shape (for example, a T-shaped seat cushion). In FIG. 19E, the seat cushion covered by the seat cushion cover 98 is placed on the seat of the covered furniture piece.

A back cushion cover as contemplated by the present invention may be applied to a variety of back cushion configurations, as illustrated for example in FIGS. 20F through 20I. The covered back cushion is then placed against the back of the furniture piece and either on top of or behind the covered seat cushion to complete application of the slipcover to the furniture piece as illustrated in FIGS. 21A-21C.

Figure 21A:
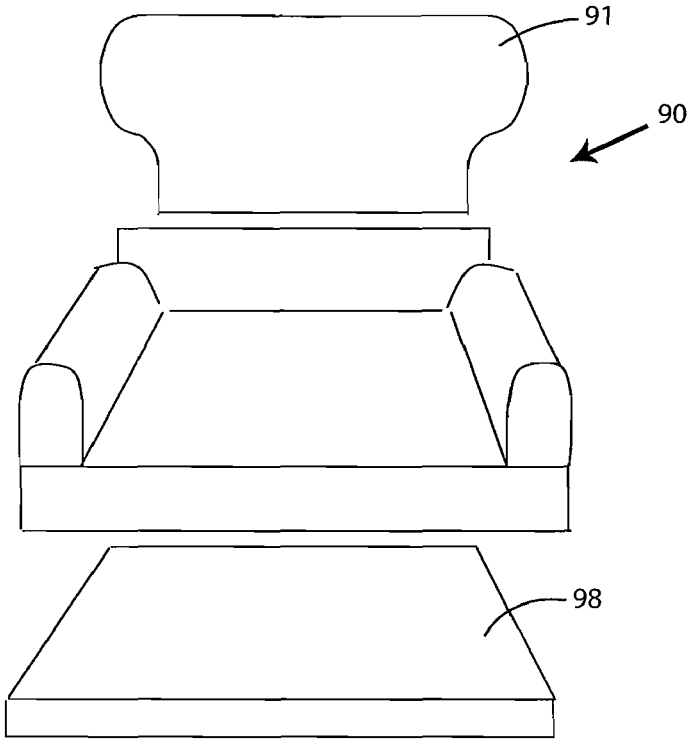
FIGS. 21A through 21C illustrate single and multiple seat and back cushion embodiments of the slipcover of FIG. 9.

For example, FIG. 21A illustrates a slipcover 90*a* having a single back cushion cover 91 and seat cushion cover 98. FIG. 21B illustrates a slipcover 90*a* having a pair ob back cushion covers 91*a*, 91*b* and a pair of seat cushion covers 98*a*, 98*b*. Finally, FIG. 21C illustrates a slipcover 90*p* having three back cushion covers 91*p*, 91*q*, 91*r* and three seat cushion covers 98*p*, 98*q*, 98*r*.

Figure 20A:
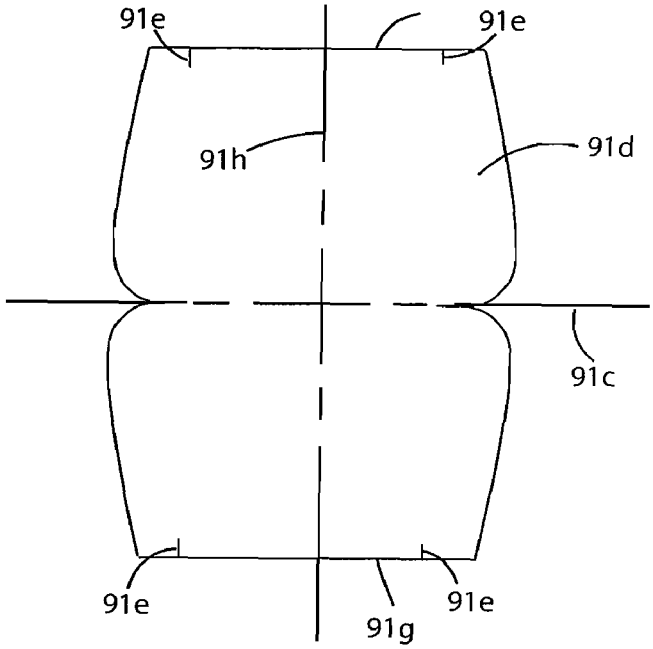
FIGS. 20A through 20I illustrate a back cushion cover, its method of assembly, and its use including insertion of one or more back cushions.

A method for making and applying the back cushion cover will be described with reference to FIGS. 20A through 20E. In FIG. 20A, the pattern shape for the back cushion panel is initially prepared as a single panel 91*d* having a "squashed hourglass" shape. Alternatively, the cover may be formed from two panels (each shaped as a half-portion of the squashed hourglass), which can be sewn together to form the hourglass. In addition, a variety of foreseeable modifications can be made to the hourglass shape without deviating from the scope of the invention as claimed, and are deemed therefore as being contemplated by the present invention. A pair of notches 91*e* is provided at each of an upper edge 91*f* and a lower edge 91*g* for zipper placement. Each pair of notches 91*e* is symmetrically spaced in relation to a longitudinal centerline 91*h* of the panel 91*d*.

Figure 20B:
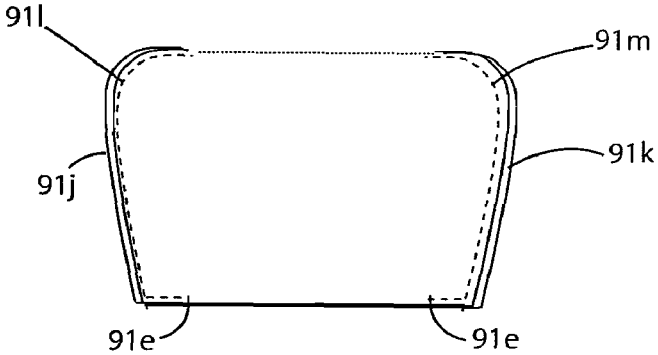

As shown in FIG. 20B, he hourglass-shaped panel 91*d* is then folded in half along a lateral centerline 91*i*, and joined at side edges 91*j*, 91*k* at seams 91*l*, 91*m* (for example, by stitching, gluing and/or welding) to form a pocket open along bottom edges of the folded hourglass. It is preferable to form the seams 91*l*, 91*m* by stitching in a three-thread overlock pattern that will extend with the fabric as it is stretched.

Figure 20C:
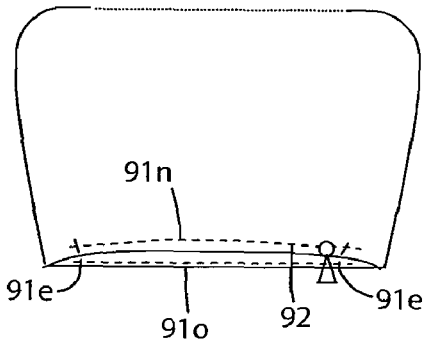

As shown in FIG. 20C, a zipper 92 is fastened in between notches 91*e* at seams 91*n*, 91*o* by stitching, gluing or welding. The zipper 92 preferably comprises a conventional zipper joining two zipper bands, as illustrated for example in FIGS. 5I-5L. The zipper bands preferably comprise a fabric that is not subject to shrinkage after washing. For a single cushion application, the length of the zipper 92 must be substantially equal to a longest length dimension of the cushion. For a multiple cushion application, the zipper 92 may be shorter than the longest length dimension of the cushions together, as the cushions may be overlapped as they are inserted through the opening provided by the zipper 92 into the cover 91.

Figure 20D:
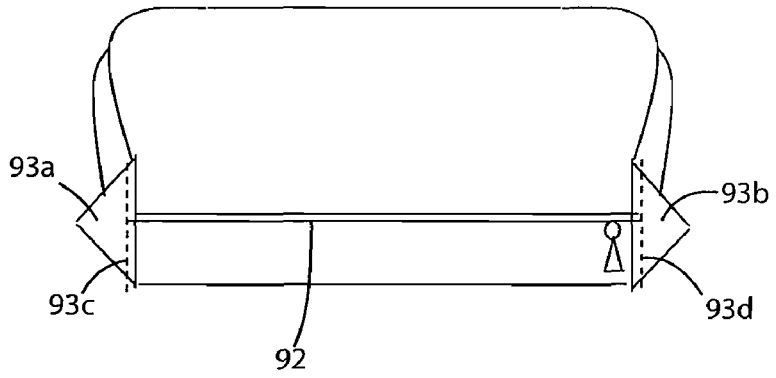
Figure 20E:
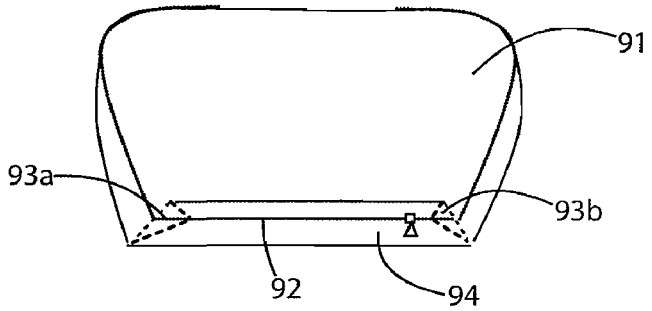

As shown in FIG. 20D, the back cushion cover is then reversed inside out so that interior surfaces of the cover are positioned externally, so that gusset panels (for example, triangularly-shaped gusset panels 93*a*, 93*b*) may formed from material in the panel 91 by forming seams 93*c*, 93*d* that are orthogonal to the zipper 92 and at longitudinally opposing ends of the zipper 92. As shown in FIG. 20E, the back cushion cover is then again reversed so that the gusset panels 93*a*, 93*b* become internally positioned. The combination of gussets 93*a*, 93*b* with relatively rigid zipper bands forms a basin 94 which remains relatively rigid and relatively fixed in shape and size, providing a stable and flat surface that enables the back cushion(s) covered by the cushion cover 91 to rest securely on top of seat cushions.

Figure 20F:
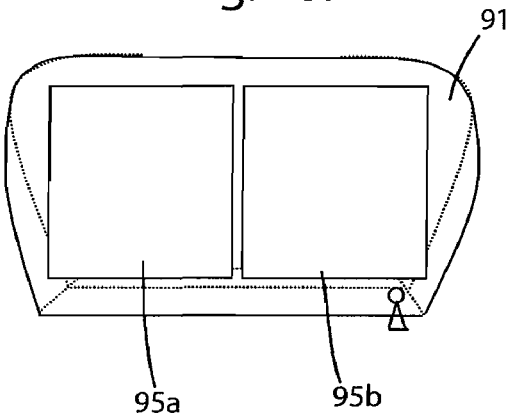

FIGS. 20F through 20I show a variety of back cushion configurations which may be form-fit using the back cushion cover of FIGS. 20A through 20E. In FIG. 20F, two square back cushions 95*a*, 95*b* are inserted into the stretched back cushion cover 91. The size of back cushion cover 91 as illustrated is exaggerated in relation to cushions 951, 95*b*. The cover 91 is actually stretched over the two cushions 95*a*. 95*b* and retracts to tightly cover and assume the shape of the two cushions 951, 95*b*.

Figure 20G:
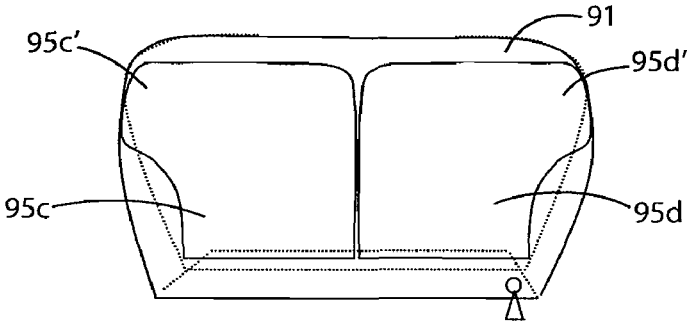
Figure 20H:
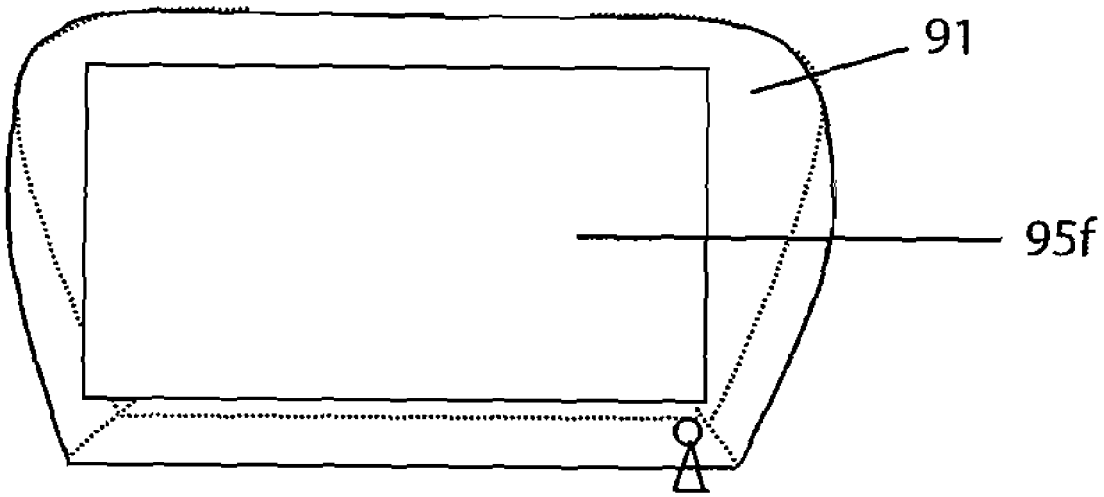
Figure 20I:
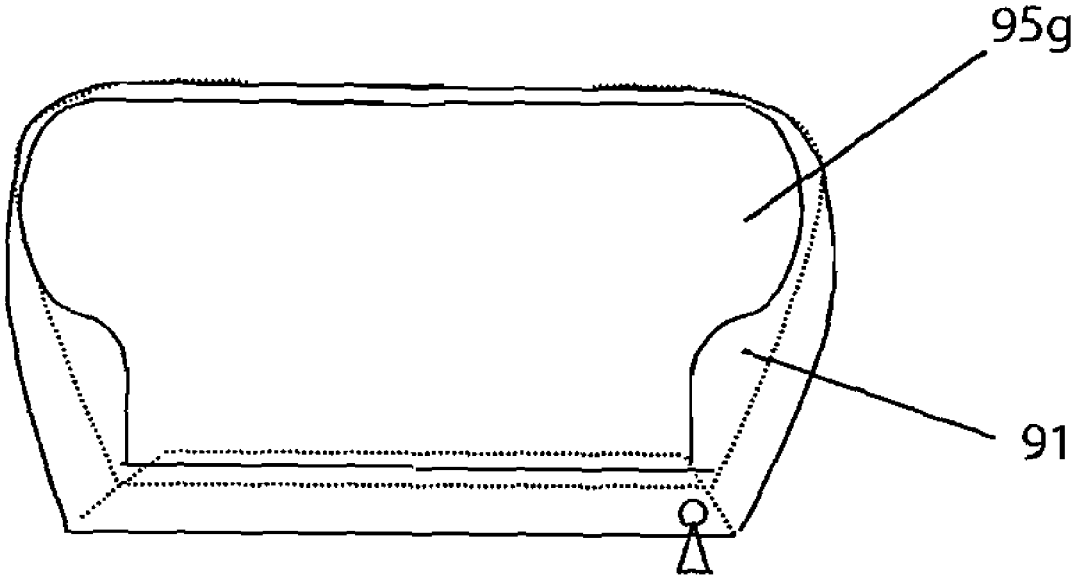
Figure 21B:
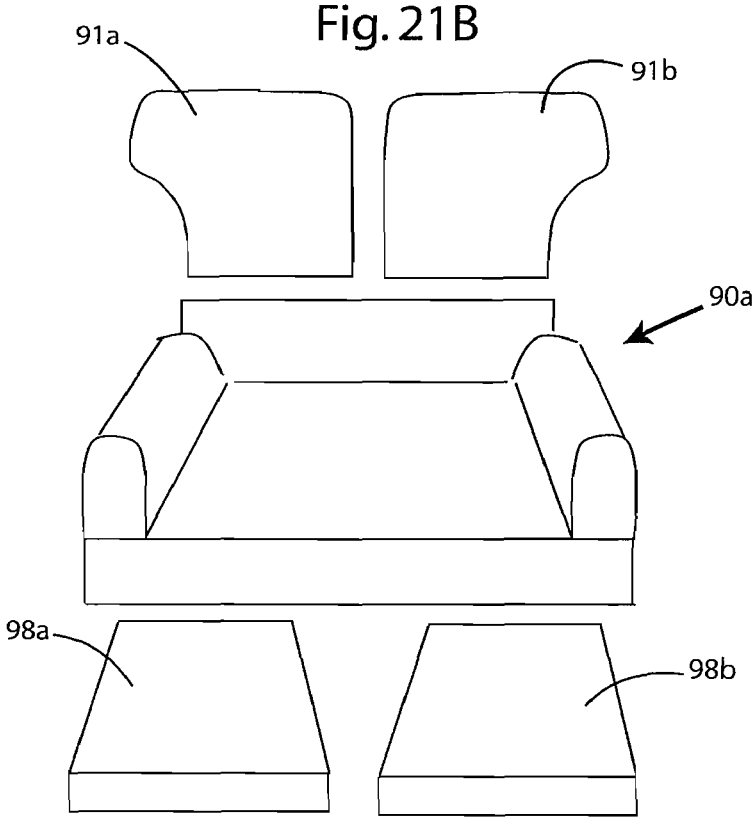
Figure 21C:
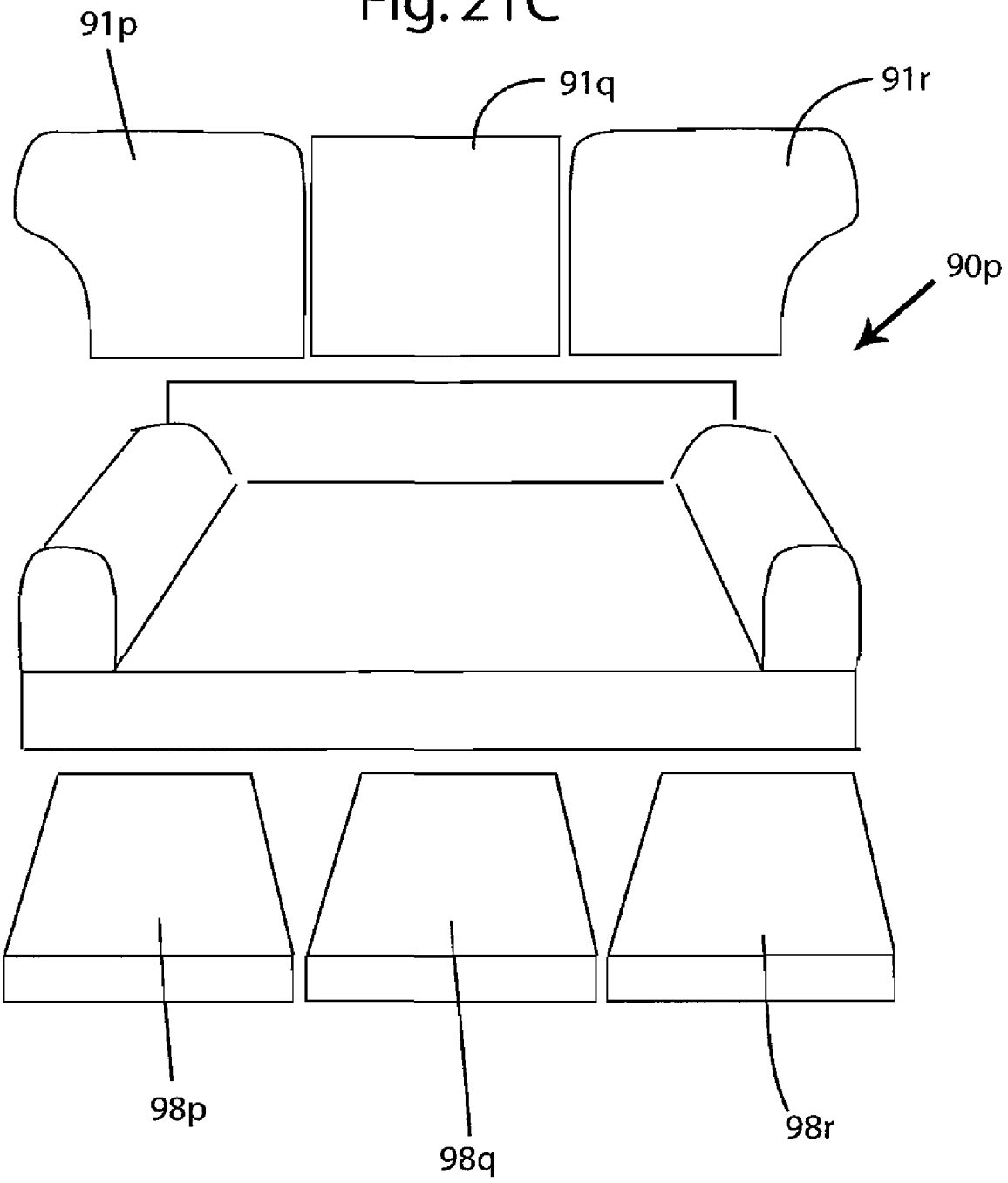

In FIG. 20G, two T-shaped cushions 95*c*, 95*d* which include lateral portions 95*c*', 95*d*' intended to extend over the arms of the love seat, are inserted into the back cushion cover (see, e.g., back cushion cover 91 of FIG. 15). In FIG. 20H, a single "box" back cushion 95 f is inserted into the back cushion cover 91. In FIG. 20I, a single T-cushion 95*g* is inserted into the back cushion cover. As in the case of FIG. 20F, the size of back cushion cover 91 in FIGS. 20G through 20I is exaggerated, as in each of these cases the cover 91 is also stretched over the cushion(s) and retracts to tightly cover and assume the shape of the two cushions. In multiple cushion applications, once the cushions have been inserted into the cover 91, it is advisable to pull the cushions apart, causing the fabric of the cover 91 to stretch in a widthwise direction and thereby compressing the cushions to uniformly compress as the fabric compacts in a lengthwise direction.

The shape of the back cushion cover is a significant feature of the present invention enabling each of the above-described back cushion configurations to be inserted into and snugly form-fit by the cover. Specifically, the front and back panels forming the squashed hourglass shape are folded and stitched to provide a cover which is somewhat wider along a top edge of the cover than along a bottom, zippered edge of the cover. The corners of the top edge are preferably contoured, and the bottom edges of the cover form the gusseted areas that are capable of stretching to accommodate and provide a form-fit to cushions of varying thicknesses.

In this manner, for a given range of cushion sizes, the inventive back cushion cover can provide a form fit to each of the variety of types of back cushion configurations described above, while leaving little to no excess fabric. As a result, the number of different back covers that need to be offered in order to provide a form-fit for the types of back cushion styles and sizes available in the marketplace is reduced. (i.e., the "SKU risk" generated with the provisioning of many different covers is reduced).

The present invention provides an additional benefit when the back cushion cover is configured to cover multiple back cushions. In this configuration, when the multiple back cushions are inserted into the back cushion cover, the back cushions are compressed together so that the cushions are maintained in a stable position. This reduces the shifting of cushions that is characteristic when the multiple cushions are individually positioned against the back portion of the furniture.

Although only a preferred embodiment of the invention has primarily been shown and described, many features may be varied, as were previously described and will readily be apparent to those skilled in this art. Thus, the foregoing description is illustrative and not limiting, and intended to include all reasonably foreseeable equivalents to the directly described features within the scope of invention as defined herein by the claims. It is also to be understood that the drawings are not necessarily drawn to scale but that they are merely conceptual in nature. It is the intention, therefore, for the invention to be limited only as indicated by the scope of the claims appended hereto.

What is claimed is:

1. A slipcover for a piece of furniture having a base including a back, a seat, and a pair of armrests, and having one or more seat cushions and one or more back cushions, wherein the one or more seat cushions and the one or more back cushions are not permanently affixed to the base, the slipcover comprising:

a base cover including one or more panels for covering each of the back, the left and right armrests, and at least a portion of the seat; and one or more back cushion covers each configured to cover one or more back cushions;

wherein the at least one back cushion cover comprises a fabric having a stretch in length which behaves dynamically with respect to a stretch in width, with the minimum stretch in fabric width being 60%, the minimum stretch in fabric length being 40%.

2. The slipcover according to claim 1, wherein the at least one back cushion cover is form-fit to the at least one back cushion when the stretch in fabric width of 60% is reduced by approximately 10% or more.

3. The slipcover according to claim 2, wherein when the slipcover is form-fit to the back cushion and the stretch in fabric width of 60% is reduced by 10%, the stretch in fabric length of 40% is reduced by 25%.

4. The slipcover according to claim 1, further comprising one or more seat cushion covers each configured to cover one or more seat cushions.

5. The slipcover according to claim 4, wherein each of the base covers and one or more seat covers comprises the fabric having a stretch in length which behaves dynamically with respect to a stretch in width.

6. The slipcover according to claim 1, further comprising an elastic band secured to a lower edge of the base cover, the lower edge defining an opening for admitting the furniture into an interior portion of the base cover.

7. The slipcover according to claim 1, wherein at least one of the one or more back cushion covers has trapezoidally-shaped front and rear surfaces enclosing an interior portion of the cover.

8. The slipcover according to claim 7, wherein the at least one back cushion cover is wider at a top edge of the trapezoidally-shaped front and rear surfaces than at a bottom edge of the trapezoidally-shaped front and rear surfaces.

9. The slipcover according to claim 7, wherein the least one back cushion cover further comprises an opening at the bottom edge for admitting the one or more back cushions into the interior portion of the cover.

10. The slipcover according to claim 9, wherein a basin portion of the cover is affixed at the opening.

11. The slipcover according to claim 10, wherein the basin portion further comprises:

a zipper;

a pair of zipper bands each opposingly affixed to the zipper; and a pair of gusset panels provided at longitudinally opposing ends of the zipper.

12. The slipcover according to claim 11, wherein the gusset panels are affixed the basin portion by seams provided at the longitudinally opposing ends of the zipper, the seams being orthogonally positioned in respect to an operating direction of the zipper.

13. The slipcover according to claim 7, wherein opposing ends of a top edge of the trapezoidally-shaped front and rear surfaces are contoured.

14. The slipcover according to claim 1, wherein the fabric comprises an elasticized yarn material.

15. The slipcover according to claim 14, wherein the elasticized yarn material comprises a spandex material.

16. A slipcover for covering a back cushion to be applied to a piece of furniture having a back and a seat having one or more seat cushions, the slipcover comprising:

an upper portion including at least one panel comprising front and rear trapezoidally-shaped portions for respectively covering front and rear surfaces of the back cushion, the front and rear trapezoidally-shaped portions enclosing an interior portion of the cover; and a basin portion affixed to the upper portion within an opening defined by bottom edges of the front and rear trapezoidally-shaped portions, wherein:

a central portion of each of the bottom edges of the front and rear trapezoidally-shaped portions is directly joined to a longest side of the basin portion, and end portions of each of the bottom edges of the front and rear trapezoidally-shaped portions are each directly joined to a shortest side of the basin portion.

17. The slipcover according to claim 16, wherein:

the bottom edge of each trapezoidally-shaped portion is parallel to a top edge of the trapezoidally shaped portion; and each of a pair of lateral edges of the front trapezoidally-shaped portion is directly joined to a lateral edge of the rear trapezoidally-shaped portion to define one of a pair of lateral edge seams.

18. The slipcover according to claim 17, wherein the top edges of each trapezoidally-shaped portion are directly joined along a top seam.

19. The slipcover according to claim 17, wherein the top edges of each trapezoidally-shaped portion are defined by a common edge of the front and rear trapezoidally-shaped portions.

20. The slipcover according to claim 16, wherein the basin portion further comprises:

a zipper;

a pair of zipper bands each opposingly affixed to the zipper; and a pair of gusset panels provided at longitudinally opposing ends of the zipper.

21. The slipcover according to claim 20, wherein the gusset panels are affixed to the basin portion by seams provided at the longitudinally opposing ends of the zipper, the seams being orthogonally positioned in respect to an operating direction of the zipper.

22. The slipcover according to claim 20, wherein the gusset panels comprise stretched portions of the front and rear trapezoidally-shaped portions.

23. The slipcover according to claim 16, wherein the trapezoidally-shaped portions each define a regular trapezoid.

24. The slipcover according to claim 16, wherein the slipcover is configured to cover a plurality of back cushions.

25. The slipcover according to claim 17, wherein corners defined by the lateral edges and the top edge of each trapezoidally-shaped portion are radiused.

26. The slipcover according to claim 16, wherein each trapezoidally-shaped portion comprises an elastic fabric material.

27. The slipcover according to claim 26, wherein the elastic fabric comprises a fabric having a stretch in length which behaves dynamically with respect to a stretch in width, with the minimum stretch in fabric width being 60%, and the minimum stretch in fabric length being 40%.

28. The slipcover according to claim 27, wherein the slipcover is form-fit to the at least one back cushion when the stretch in fabric width of 60% is reduced by approximately 10% or more.

29. The slipcover according to claim 28, wherein when the slipcover is form-fit to the back cushion and the stretch in fabric width of 60% is reduced by 10%, the stretch in fabric length of 40% is reduced by 25%.

30. A method for assembling a slipcover for covering a back cushion to be applied to a piece of furniture having a back and a seat having one or more seat cushions, the method comprising the steps of:

forming an upper portion of the slipcover including at least one panel comprising front and rear trapezoidally-shaped portions for respectively covering front and rear surfaces of the back cushion, the front and rear trapezoidally-shaped portions enclosing an interior portion of the cover;

joining each of a pair of lateral edges of the front trapezoidally-shaped portion to a lateral edge of the rear trapezoidally-shaped portion to define one of a pair of lateral edge seams in the upper portion forming a basin portion of the slipcover; and affixing the basin portion to the upper portion within an opening defined by bottom edges of the front and rear trapezoidally-shaped portions.

31. The method according to claim 30, wherein the step of forming the basin portion further includes the steps of:

providing a zipper;

providing a pair of zipper bands; and affixing the pair of zipper bands to opposing sides of the zipper.

32. The method according to claim 31, wherein the step of affixing the basin portion further includes the steps of:

joining a central portion of each of the bottom edges of the front and rear trapezoidally-shaped portions to a longest side of the basin portion, joining end portions of each of the bottom edges of the front and rear trapezoidally-shaped portions to a shortest side of the basin portion; and providing a pair of gusset panels at longitudinally opposing ends of the zipper.

33. The method according to claim 30, wherein the step of forming the upper portion of the slipcover further includes the steps of:

providing a fabric having a stretch in length which behaves dynamically with respect to a stretch in width, with the minimum stretch in fabric width being 60%, the minimum stretch in fabric length being 40%; and forming the at least one panel comprising front and rear trapezoidally-shaped portions from the provided fabric.

* * * * *